US008985355B2

(12) United States Patent
Wilt

(10) Patent No.: US 8,985,355 B2
(45) Date of Patent: Mar. 24, 2015

(54) RAILCAR DRAFT GEAR ASSEMBLY AND RELATED METHOD FOR ASSEMBLING A RAILCAR DRAFT GEAR

(71) Applicant: Donald E. Wilt, Batavia, IL (US)

(72) Inventor: Donald E. Wilt, Batavia, IL (US)

(73) Assignee: Miner Enterprises, Inc., Geneva, IL (US)

( * ) Notice: Subject to any disclaimer, the term of this patent is extended or adjusted under 35 U.S.C. 154(b) by 169 days.

(21) Appl. No.: 13/746,547

(22) Filed: Jan. 22, 2013

(65) Prior Publication Data

US 2014/0202973 A1 Jul. 24, 2014

(51) Int. Cl.
*B61G 7/00* (2006.01)
*B61G 9/06* (2006.01)

(52) U.S. Cl.
CPC ... *B61G 7/00* (2013.01); *B61G 9/06* (2013.01)
USPC ..... 213/45

(58) Field of Classification Search
CPC ..... B61G 9/06; B61G 11/08
USPC ..... 213/40 R, 44, 45, 46 A, 46 R
See application file for complete search history.

(56) References Cited

U.S. PATENT DOCUMENTS

| | | | |
|---|---|---|---|
| 3,581,909 | A | 6/1971 | Peterson |
| 4,198,037 | A | 4/1980 | Anderson |
| 4,576,295 | A | 3/1986 | Carlstedt |
| 4,591,059 | A | 5/1986 | Hammarlund |
| 4,735,328 | A | 4/1988 | Carlstedt |
| 4,960,215 | A | 10/1990 | Carlstedt |
| 5,104,101 | A | 4/1992 | Anderson et al. |
| 5,351,844 | A | 10/1994 | Carlstedt |
| 6,478,173 | B2 | 11/2002 | Carlstedt |
| 6,488,162 | B1 | 12/2002 | Carlstedt |
| 6,520,360 | B1 | 2/2003 | Withall et al. |
| 6,792,871 | B2 | 9/2004 | O'Donnell et al. |
| 6,796,448 | B1 | 9/2004 | Wilt et al. |
| 6,862,999 | B2 | 3/2005 | Wilt et al. |
| 6,877,623 | B2 | 4/2005 | Salis |
| 7,044,061 | B2 | 5/2006 | O'Donnell et al. |
| 7,624,884 | B2 | 12/2009 | Palermo et al. |
| 2012/0292279 | A1 | 11/2012 | Wilt et al. |

*Primary Examiner* — Zachary Kuhfuss
(74) *Attorney, Agent, or Firm* — Law Office of John W. Harbst

(57) ABSTRACT

A railcar draft gear assembly including a housing, a spring sea, a spring and a friction clutch assembly in operable combination relative to each other within the housing. The spring includes a series of axially stacked elastomeric pads arranged between a closed end of the housing and the spring seat. An axially elongated guide rod is endwise passed through the spring seat and elastomeric pads for aligning the pads relative to a longitudinal axis of the draft gear assembly. The guide rod is operably inhibited from axial shifting movements during operation of the draft gear assembly. A related method for assembling the draft gear is also disclosed.

28 Claims, 12 Drawing Sheets

RAILCAR DRAFT GEAR ASSEMBLY AND RELATED METHOD FOR ASSEMBLING A RAILCAR DRAFT GEAR

FIELD OF THE INVENTION DISCLOSURE

This invention disclosure generally relates to a railcar draft gear assembly and, more specifically, to a railcar draft gear assembly utilizing a spring assembly comprised of a stack of elastomeric pads and an elongated guide rod for maintaining the stacked pads in general alignment relative to each other and relative to a longitudinal axis of the draft gear assembly whereby optimizing spring performance.

BACKGROUND

A railroad freight car draft gear assembly has been used for years at opposite ends of a railcar to absorb and cushion impact forces directed against and to the railcar. Most railcar draft gear assemblies include a housing having an inner tapered bore at an open end, an elongated spring arranged within the housing, and a friction clutch assembly including a series of friction members along with a wedge or actuator arranged in the tapered bore of the housing and movable against the spring upon compression of the draft gear assembly. The wedge is arranged in operable combination with the friction members such that impact blows directed against the wedge are transferred axially to the spring and radially to the housing. A spring seat can be arranged between an end portion of each friction member and the spring.

Recently, elastomeric materials have been used and accepted as replacements for steel springs. One elastomeric spring assembly offering beneficial results is disclosed in U.S. Pat. No. 5,351,844 to R. A. Carlstedt and includes multiple elastomeric spring units stacked in axial relation relative to each other. Each spring unit of the spring assembly includes an elastomer pad sandwiched between two metal plates. The metal plates are bonded or otherwise secured to opposed faces of the elastomer pad. Amongst other advantages, the metal plates serve to limit snaking and/or buckling problems while furthermore serving to center the elastomeric spring assembly relative to the draft gear housing. Such a spring assembly has been successfully used for years in combination with railcar draft gears.

In one form, the draft gear housing is provided with an elongated opening between a closed end and an open end of the housing and extending along a sidewall of the draft gear housing to allow the spring units to be inserted in a direction generally normal to a longitudinal axis of the draft gear assembly and stacked relative to each other within the draft gear housing. Maintaining the spring units in alignment relative to each other and generally centered relative to the longitudinal axis of the draft gear assembly is an important consideration when designing a railcar draft gear assembly. Moreover, maintaining the elongated spring assembly in relatively centered relationship relative to the longitudinal axis of the draft gear is also important to overall performance of the draft gear assembly.

The draft gear assembly is arranged within a pocket in the railcar and extends generally parallel to a longitudinal axis of the railcar. Accordingly, when the railcar travels through a curve, the railcar tends to impart unequal forces to the draft gear assembly. Such unequal forces applied to the draft gear assembly are also frequently transferred to the elongated spring assembly tending for the individual spring units to become misaligned relative to each other and relative to the longitudinal axis of the draft gear. As mentioned, displacement of the individual spring units relative to each other and relative to the longitudinal center of the draft gear assembly can result in undesirable overall performance of the railcar draft gear assembly.

Railcar manufacturers and suppliers for supplying such railcar manufacturers are continually seeking methods and ways of reducing the manufacturing costs of railcars and the components used to build such railcars without having to sacrifice performance and quality. When considering costs savings in connection with a draft gear assembly, however, the available options are few. First, the size of the draft gear housing cannot be changed without adversely affecting the relationship of the fixed size pocket in a railcar centersill wherein the draft gear assembly is accommodated. Second, and with the size of the draft gear assembly being standardized or fixed, the amount of steel used to form the draft gear housing has already been minimized as with openings and voids wherever possible. Exacerbating these design challenges is the fact that speeds of railcars are steadily increasing, thus, adding to the impact loads imparted to the draft gear assembly during railcar operation. As such, the size of the spring assembly used to absorb, dissipate and return energy imparted thereto during railcar operations cannot be reduced without adversely affecting performance and operation of the draft gear assembly.

Thus, there remains a continuing need and desire to provide a railcar draft gear assembly which is economically designed to have high shock absorbing capacities while offering enhanced performance by maintaining the spring units of the elongated spring assembly in aligned relation relative to each other and relative to the longitudinal axis of the draft gear assembly.

SUMMARY

In accordance with one aspect there is provided a railcar draft gear assembly having a longitudinal axis and including a housing having a closed end, an open end; and wall structure extending between the ends, with the housing wall structure defining a spring chamber and an opening in a side thereof. A friction clutch assembly is arranged in operable combination with the open end of the housing and includes a wedge member. A spring seat is guided for reciprocal movements within the spring chamber in response to forces being exerted upon the draft gear assembly. The spring seat has a generally centralized bore which opens to opposed surfaces thereof. An elongated spring is operably disposed within and between the closed end of the housing and the clutch assembly for absorbing, dissipating and returning energy imparted to the draft gear assembly. The spring includes a series of axially stacked elastomeric pads which are inserted into the spring chamber through the opening in the side of the housing in a direction generally normal to the longitudinal axis of the draft gear assembly. Each elastomeric pad has a generally centralized bore opening to opposed surfaces of the pad. An elongated guide rod, having an axis arranged generally coaxial with the longitudinal axis of the draft gear, is insertable endwise through the spring seat and pads after the spring seat and pads are inserted into the spring chamber for maintaining general alignment of the pads relative to each other and relative to the longitudinal axis of the draft gear assembly. Structure, arranged within the housing, is provided for inhibiting endwise displacement of the guide rod during operation of the draft gear assembly.

In one form, the friction clutch assembly further includes a series of friction members arranged in equally spaced relation relative to each other and in operable combination with the wedge member. Preferably, the open end of the housing defines a series of inner angled longitudinally extended surfaces extending from the open end of the housing, with each inner angled surface on the housing combining with an outer angled surface on each friction member to define an angled surface therebetween.

In one embodiment, the structure for inhibiting endwise displacement of the guide rod during operation of the draft gear assembly includes interlocking instrumentalities provided on the elongated guide rod and the housing. In another form, the structure for inhibiting endwise displacement of the guide rod includes a latching mechanism selectively operable between locked and unlocked conditions in response to rotation of the elongated guide rod about the axis thereof. In one form, such a latching mechanism includes a latch secured toward a first end of and rotatable with the elongated guide rod, and a keeper carried by the housing and selectively arranged in operable combination with the latch.

In this later embodiment, the guide rod is configured toward a second end to facilitate rotation of the guide rod about the axis thereof. Moreover, the structure for inhibiting endwise displacement of the guide rod during operation of the draft gear assembly further includes an apparatus arranged toward the second end of the elongated guide rod for inhibiting inadvertent rotation of the guide rod about the axis thereof whereby maintaining the latch and keeper in position relative to each other to inhibit endwise displacement of the guide rod after the guide rod is inserted through the pads.

In another form, the latching mechanism includes a latch toward a first end of and rotatable with the guide rod, and a keeper provided on a plate disposed between the closed end of the housing and the elastomeric pad of the spring disposed closest to the closed end of the housing. In this embodiment, the guide rod is configured toward a second end to facilitate rotation of guide rod about the axis thereof. The structure for inhibiting endwise displacement of the guide rod during operation of the draft gear assembly can furthermore include an apparatus arranged toward the second end of the elongated guide rod for inhabiting inadvertent rotation of the guide rod about its axis whereby maintaining the latch and keeping in position relative to each other to inhibit endwise displacement of the guide rod after it is inserted through the pads.

According to another aspect, there is provided a railcar draft gear assembly having a longitudinal axis and includes an axially elongated metal housing having a closed end, an open end; and wall structure extending between the ends, with the wall structure defining a spring chamber and an opening in a side thereof: A friction clutch assembly, including an actuator extending at least partially beyond the open end of the housing and a series of equi-distantly spaced friction members, is arranged in operable combination with and between the actuator and the open end of the housing. A spring seat is disposed in the housing for guided reciprocatory movements and extends generally normal to the longitudinal axis of the draft gear assembly. The spring seat has a generally centralized bore opening to opposed surfaces thereof. An elongated spring is operably disposed within and between the closed end of the housing and the spring seat for absorbing, dissipating and returning energy imparted to the draft gear assembly. The spring includes a series of axially stacked elastomeric pads which are inserted into the chamber through the opening in the side of the housing in a direction generally normal to the longitudinal axis of the draft gear assembly. Each elastomeric pad has a generally centralized bore opening to opposed surfaces of the pad. An elongated guide rod is insertable endwise through the spring seat and pads after they are inserted into and arranged in stacked relationship in the spring chamber. Structure, arranged within the housing, is provided for inhibiting endwise displacement of the guide rod during operation of the draft gear assembly.

Preferably, the friction members of the friction clutch assembly are arranged in equally spaced relation relative to each other. In one embodiment, the open end of the housing defines a series of inner angled longitudinally extended surfaces extending from the open end of the housing, with one inner angled surface on the housing combining with an outer angled surface on each friction member to define an angled surface therebetween.

In a preferred form, the structure for inhibiting endwise displacement of the guide rod during operation of the draft gear assembly includes interlocking instrumentalities provided on the elongated guide rod and the housing. In one form, such interlocking instrumentalities includes a latching mechanism selectively operable between locked and unlocked conditions in response to rotation of the elongated guide rod about the axis thereof. In one form, such a latching mechanism includes a latch secured toward a first end of and rotatable with the elongated guide rod, and a keeper carried by the housing and selectively arranged in operable combination with the latch. In this later embodiment, the guide rod is preferably configured toward a second end to facilitate rotation of guide rod about the axis thereof.

Preferably, the structure for inhibiting endwise displacement of the guide rod during operation of the draft gear assembly further includes an apparatus arranged toward the second end of the guide rod for inhibiting inadvertent rotation of the guide rod about the axis thereof. As such, the latch and keeper are releasably maintained in position relative to each other to inhibit endwise displacement of the guide rod after the guide rod is inserted through the pads.

Alternatively, the latching mechanism includes a latch secured toward a first end of and rotatable with the elongated guide rod. In this embodiment, a keeper is provided on a plate disposed between the closed end of the housing and the elastomeric pad of the spring disposed closest to the closed end of the housing. In this later embodiment, the guide rod is configured toward a second end to facilitate rotation of the guide rod about the axis thereof. The structure for inhibiting endwise displacement of the guide rod during operation of the draft gear assembly further includes an apparatus arranged toward the second end of the elongated guide rod for inhibiting inadvertent rotation of the guide rod about the axis thereof whereby releasably maintaining the latch and keeper in position relative to each other to inhibit endwise displacement of the guide rod after the guide rod is inserted through the pads.

According to another aspect there is provided a method of assembling a railcar draft gear assembly having a longitudinal axis and including a housing with a closed end, an open end, and wall structure extending between the closed and open ends so as to define a chamber, with the housing wall structure defining an opening having a closed margin in the side of the housing. The method of assembling a railcar draft gear assembly includes the steps of: inserting a spring seat through the housing opening and into the chamber in a direction extending generally normal to the longitudinal axis of the draft gear assembly, with the spring seat defining a generally centralized bore opening to opposed surfaces thereof. Next, the spring seat is held in a releasably raised position relative to the opening defined by the housing. Then, a series of elastomeric pads are inserted into the chamber in a direction extending generally normal to the longitudinal axis of the draft gear assembly such that the pads are stacked one upon the other to define a spring between the closed end of the housing and the spring seat, with each pad having a generally centralized bore opening to opposed surfaces of the pad. The spring seat is then released from its raised position relative to the opening defined by the housing. The spring is compressed. An elongated guide rod is passed through the centralized bore in the spring seat and though the generally centralized bore in each of the pads so as to maintain general alignment of the pads relative to each other and relative to the longitudinal axis of the draft gear assembly. The guide rod has an elongated axis. Compression of the spring is released so as to allow the spring to push the spring seat upwardly against the housing. The end of the guide rod is secured within the housing and in general alignment with the longitudinal axis of the draft gear assembly so as to maintain general alignment of the pads relative to each other and relative to the longitudinal axis of the draft gear assembly while inhibiting endwise displacement of the guide rod relative to the housing during operation of the draft gear assembly. Then, a friction clutch assembly is pressed into operable combination with the open end of the housing until an actuator of the friction clutch assembly is captured by the housing.

Preferably, the method further involves the step of: aligning the pads inserted into the chamber relative to each other before compressing the spring.

After the spring seat is initially released, the step of compressing the spring preferably involves the further steps of: a) initially compressing a first set of elastomeric pads within the housing; b) holding the first set of elastomeric pads axially compressed within the housing to allow at least one additional elastomeric pad to be stacked upon the first set of elastomeric pads; c) again raising the spring seat to a position relative to the opening in the side of the housing whereby allowing at least one additional elastomeric pad to be inserted into the spring chamber in a direction extending generally normal to the longitudinal axis of the draft gear assembly and in generally axially aligned and stacked relationship with the first set of pads, with the one additional elastomeric pad having a generally centralized bore opening to opposed surfaces thereof; d) releasing the spring seat from its raised position relative to the opening defined by the housing; and, then, e) compressing all the pads in the chamber.

According to one method of assembling-a railcar draft gear assembly the step of: holding the set of elastomeric pads in an axially compressed state within the housing involves using a plurality of bars in operable combination with the uppermost elastomeric pad in the set of pads arranged in the housing. After compressing all the pads in the chamber, the plurality of bars extending arranged in operable combination with the uppermost elastomeric pad in the set of pads are removed.

In one form, the step of: securing a first end of the guide rod within the housing and in general alignment with the longitudinal axis of the draft gear assembly preferably involves rotating the guide rod to interengage cooperating instrumentalities on a latching mechanism arranged within the housing. According to this aspect, the method of assembling a railcar draft gear assembly further involves the step of: inhibiting rotation of the guide rod during operation of the draft gear assembly. Preferably, an end section of the guide rod is configured to facilitate rotation of the guide rod about the axis thereof.

DETAILED DESCRIPTION

Figure 1:
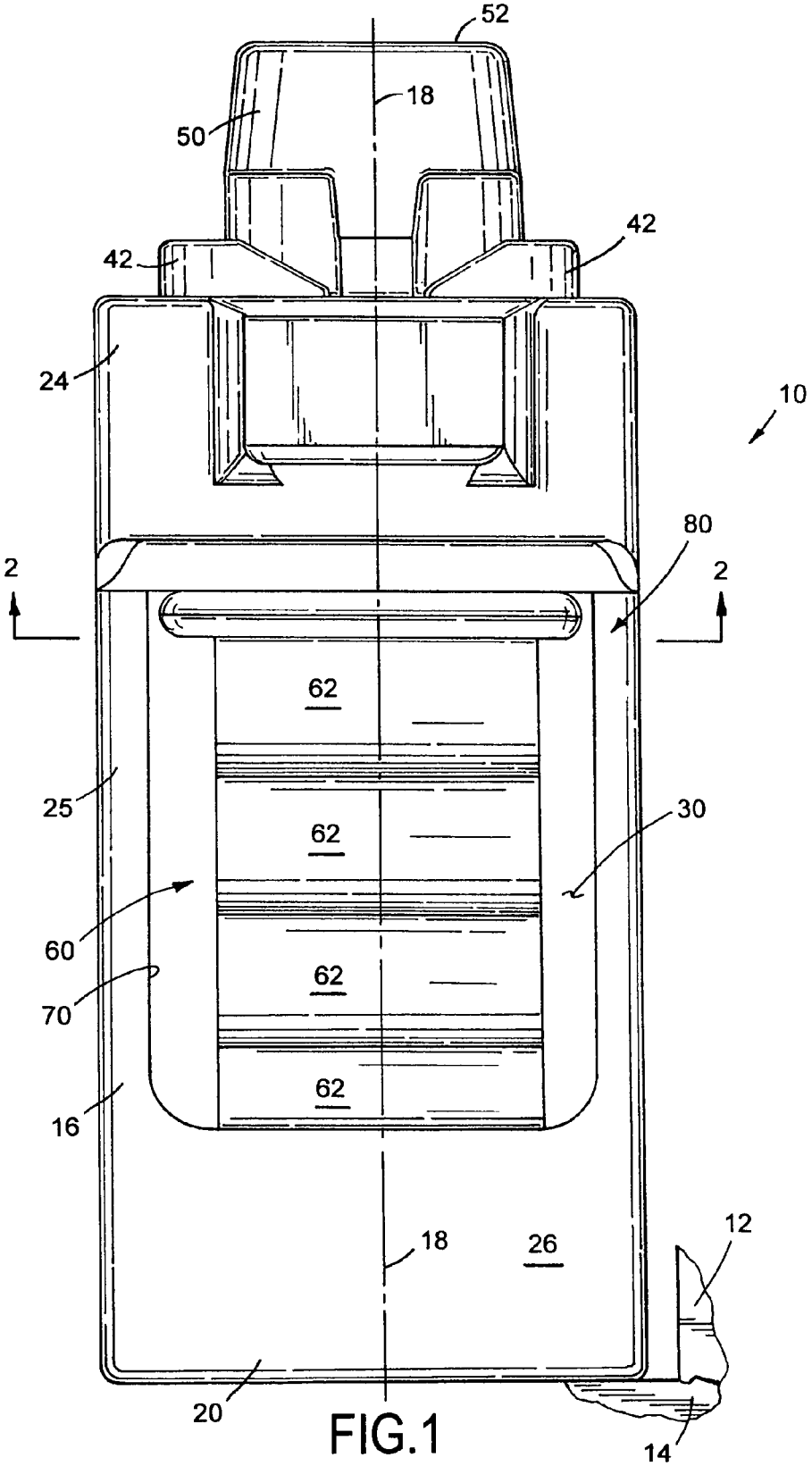
FIG. 1 is an elevational view of one form of railcar draft gear embodying principals and teachings of the present invention disclosure.

While this invention disclosure is susceptible of embodiment in multiple forms, there are shown in the drawings and will hereinafter be described preferred embodiments, with the understanding the present disclosure sets forth exemplifications of the disclosure which are not intended to limit the disclosure to the specific embodiments illustrated and described.

Figure 3:
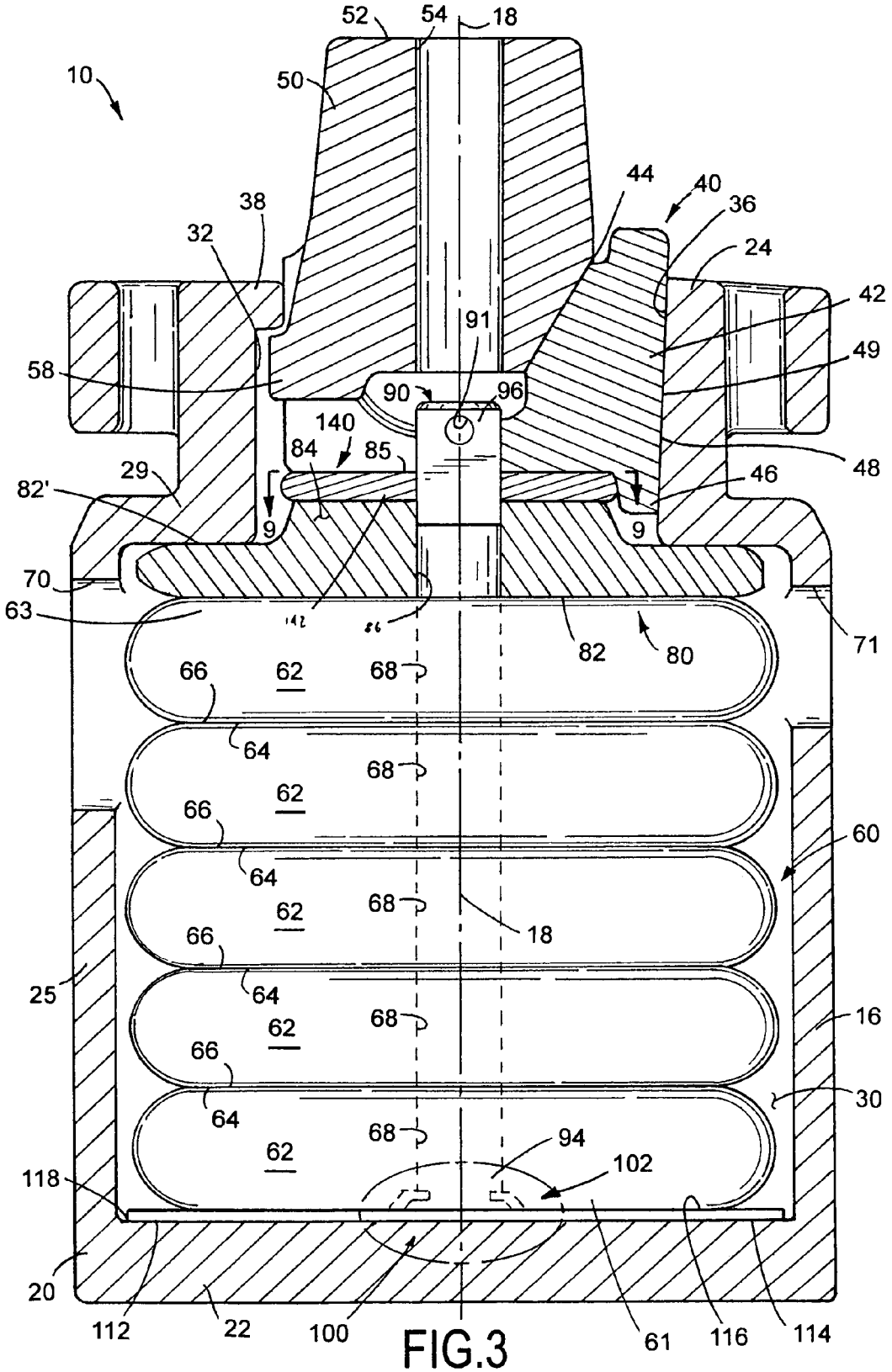
FIG. 3 is a longitudinal sectional view of the draft gear illustrated in FIG. 1.

Referring now to the drawings, wherein like reference numerals indicate like parts throughout the several views, there is shown in FIG. 1 a railcar draft gear assembly, generally indicated by reference numeral 10, adapted to be carried within a yoke 12 arranged in operable combination with a centersill (not shown) of a railcar 14. Assembly 10 includes an axially elongated hollow and metallic housing 16 defining a longitudinal axis 18 for the draft gear assembly 10. Housing 16 has a first or closed end 20 having a rear or end wall 22 (FIG. 3) and is open toward an axially aligned second or open end 24. As shown in FIG. 3, the open end 24 of housing 16 is configured smaller than the closed end 20. As such, and toward the open end 24, housing 16 defines an inwardly directed shoulder or transitional step 29.

Figure 2:
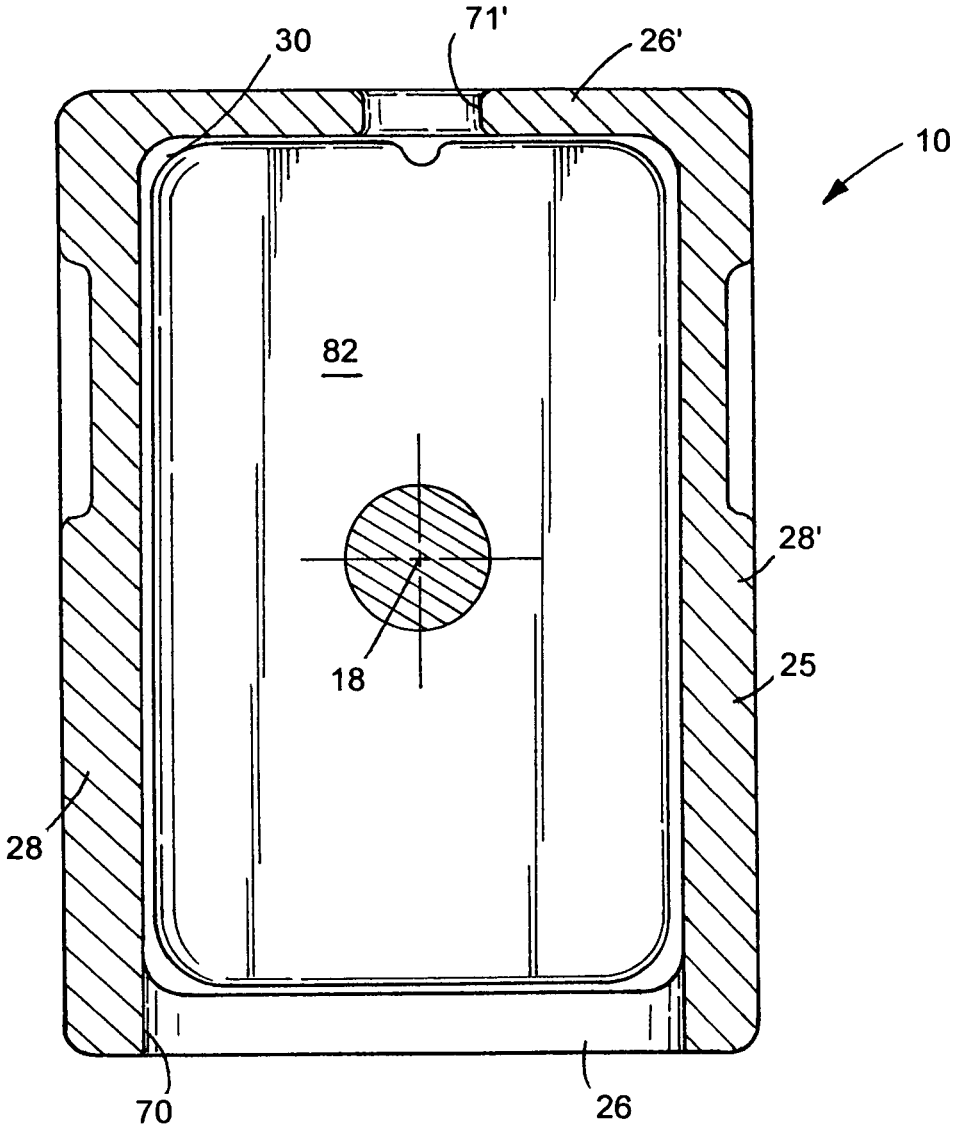
FIG. 2 is a sectional view taken along line 2-2 of FIG. 1.

Housing 16 also includes wall structure 25. In the embodiment shown for exemplary purposes in FIG. 2, housing wall structure 25 includes two pairs of joined and generally parallel walls 26, 26' and 28, 28', extending from the closed end 22 toward the open end 24 (FIG. 1), and defines a spring chamber 30 (FIGS. 1 and 3). In the example illustrated in FIG. 2, the walls 26, 26' and 28, 28' provide chamber 30 with a generally rectangular or box-like cross-sectional configuration for a major lengthwise portion thereof.

Figure 4:
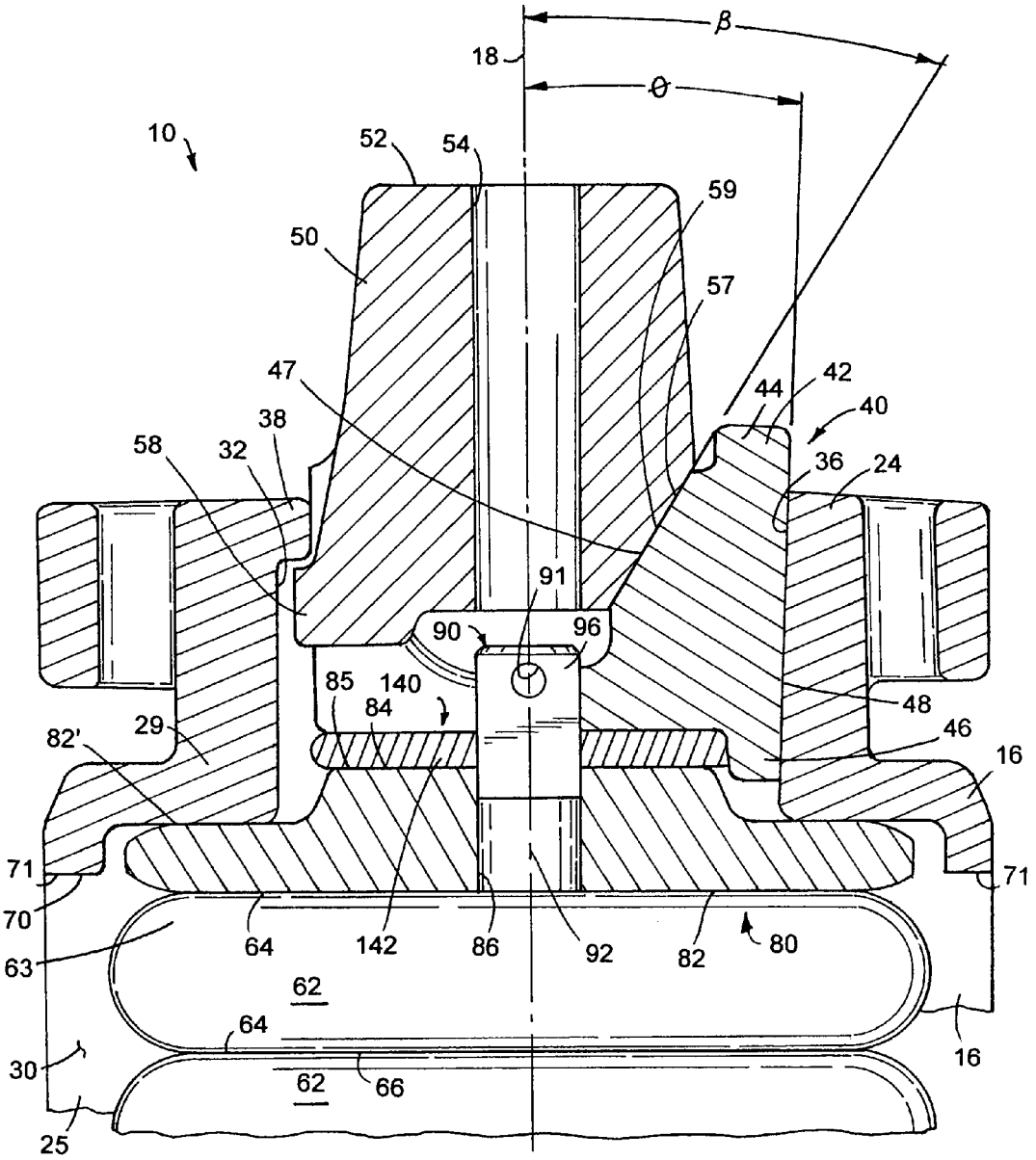
FIG. 4 is an enlarged sectional view of one end of the draft gear illustrated in FIG. 3.

As shown in FIGS. 3 and 4, the draft gear housing 16 has a friction bore 32 which opens to spring chamber 30 and to end 24 of the draft gear housing 16. Moreover, and as shown in FIG. 3, the internal friction bore 32 is provided with a plurality (with only one being shown in FIGS. 3 and 4) of equi-angularly spaced and longitudinally extended tapered inner angled friction surfaces 36. The inner angled friction surfaces 36 on housing 16 converge toward the longitudinal axis 18 and toward the closed end 20 of the draft gear housing 16. Preferably, housing 16 is provided with three equally spaced, longitudinally extended and angled inner angled friction surfaces 36 but more angled surfaces could be provided without detracting or departing from the spirit and novel concept of this invention disclosure.

In the embodiment shown in FIG. 3, and toward the open end 24 of housing 16, draft gear assembly 10 is provided with a friction clutch assembly 40 for absorbing draft forces or impacts axially directed against the draft gear 10. In the embodiment shown in FIG. 3, the friction clutch assembly 40 includes a plurality of friction members or shoes 42 arranged about axis 18 and in operable combination with the tapered inner angled friction surfaces 36 at the open end of the draft gear housing 16. In the illustrated embodiment, the friction clutch assembly 40 includes three equi-angularly spaced friction members 42 but more friction members could be provided without detracting or departing from the spirit and novel concept of this invention disclosure. In the embodiment shown by way of example in FIGS. 3 and 4, the number of friction members 42 forming part of the friction clutch assembly 40 are equal in number to the number of tapered inner angled friction surfaces 36 on housing 16.

Turning to FIG. 4, each friction member 42 has longitudinally spaced first and second ends 44 and 46, respectively. Moreover, each friction member 42 has an outer or external angled sliding surface 48. When the draft gear 10 is assembled, each inner angled friction surface 36 on housing 16 combines with each outer angled sliding surface 48 on each friction member to define a first angled friction sliding surface 49 therebetween. The first friction sliding surface 49 is disposed at an angle (FIG. 4) relative to the longitudinal axis 18 of the draft ger assembly 10.

In the illustrated embodiment, the friction clutch assembly 40 further includes a wedge or actuator 50 arranged for axial movement relative to the open end 24 of housing 16. As shown in FIGS. 1, 3 and 4, an outer end 52 of the wedge 50 preferably has a generally flat face that extends beyond the open end 24 of housing 16 and is adapted to bear on the usual follower (not shown) of a railway draft rigging such that draft or impact forces can be axially applied to the draft gear assembly 10 during operation of the railcar 14. As known, wedge 50 is arranged in operable combination with and is generally centered relative to the longitudinal axis 18 of draft gear assembly 10 by the friction members 42.

Turning again to FIG. 4, wedge 50 defines a plurality of substantially identical outer slanted or angled friction surfaces 57 arranged in operable combination with the friction members 42 of clutch assembly 40. Only one friction surface 57 is shown in FIGS. 3 and 4. It will be appreciated, however, the number of friction surfaces 57 on wedge member 50 preferably equals the number of fiction members 42 forming part of the clutch assembly 40. Of course, alternative designs are equally applicable without detracting or departing from the spirit and scope of this invention disclosure. When the draft gear 10 is assembled, each friction surface 57 on wedge 50 combines with an angled sliding surface 47 on each friction member 42 to define a second angled friction sliding surface 59 therebetween. The friction sliding surface 59 is disposed at an angle relative to the longitudinal axis 18 of draft gear 10.

Wedge 50 is formed from any suitable metallic material. In a preferred form, wedge member 50 is formed from an austempered ductile iron material. Moreover, and as shown in FIGS. 3 and 4, the wedge member or actuator 50 defines a generally centralized longitudinally extending bore 54 which, in a preferred embodiment, opens to opposed ends of wedge 50.

As shown in FIGS. 3 and 4, at its open end 24, housing 16 is provided with a series of radially inturned stop lugs 38 which are equi-angularly spaced circumferentially relative to each other. As well known, and toward a rear or inner end thereof, wedge 50 includes a series of radially outwardly projecting lugs 58 which are equi-angularly disposed relative to each other and extend between adjacent friction members 42 so as to operably engage in back of the lugs 38 on housing 16 to retain the friction members 42 and wedge 50 in assembled relation relative to the housing 16 and under the influence of a spring, generally identified by reference numeral 60.

Spring 60 has an axially elongated configuration and is generally centered within spring chamber 30 of the draft gear housing 16. Spring 60 forms a resilient column for storing dissipating and returning energy imparted or applied to the free end 52 of wedge 50 during operation of the draft gear assembly 10. As mentioned, spring 60 is precompressed during assembly of the draft gear assembly 10 and serves to maintain the components of the friction clutch assembly 40, including friction members 42 and wedge 50, in operable combination relative to each other and within the draft gear housing 16. In one embodiment, spring 60 develops about a 10,000 pound preload force for the draft gear assembly 10 and, in combination with the friction clutch assembly 40. is capable of absorbing, dissipating and returning impacts or energy directed axially thereto in the range of between 450, 000 lbs. and about 700,000 lbs.

As shown in FIG. 3, spring 60 has a first end 61 which engages with the rear wall 22 at the closed end 20 of the draft gear housing 16 and a second end 63 arranged in axially spaced relation from the first end 61. In the embodiment illustrated by way of example in FIGS. 1 and 3, spring 60 is comprised of a multi-tired structure including a plurality of individual elastomeric pads or springs 62 arranged in axially stacked relationship relative to each other.

Figure 5:
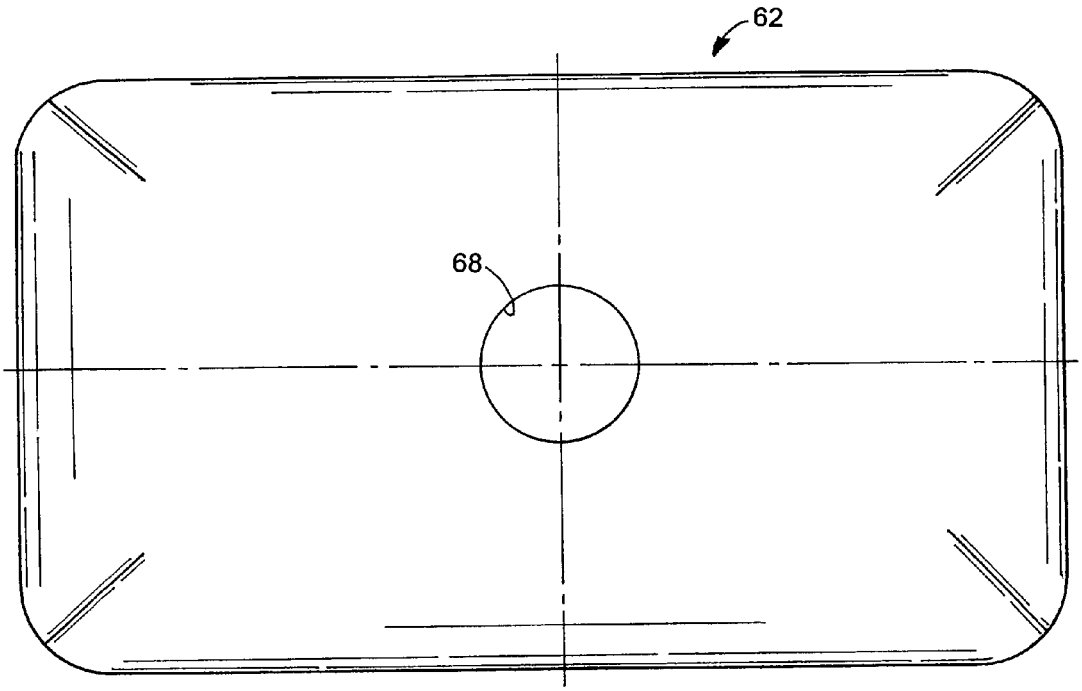
FIG. 5 is a top plan view of an elastomeric spring unit or pad forming part of a spring.
Figure 6:
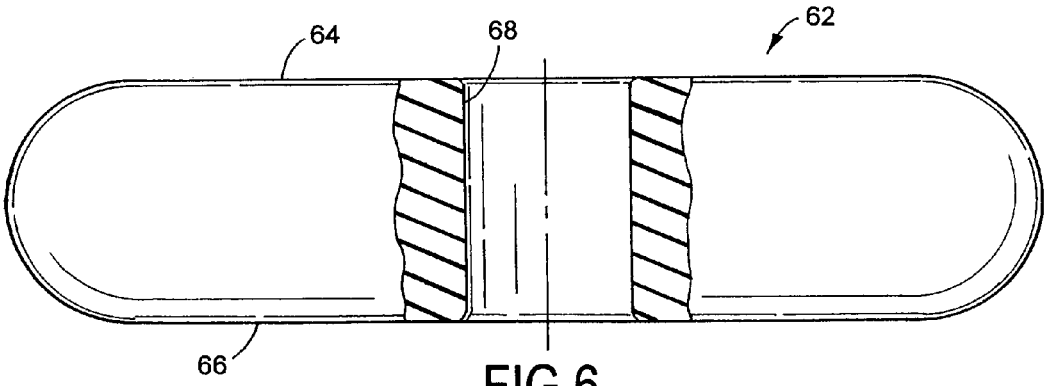
FIG. 6 is an elevational view, partly in section, of the spring unit illustrated in FIG. 5.

Each elastomeric pad preferably has a generally rectangular shape (FIG. 5), in plan, so as to optimize the rectangular area of the chamber 30 (FIG. 3) wherein spring 60 is centered and arranged for axial endwise movements in response to loads or impacts being exerted axially against assembly 10. Preferably, each pad 62 has a Shore D hardness ranging between about 40 and about 60. In the form shown in FIGS. 3 and 6, each pad 62 has first and second generally flat and generally parallel surfaces 64 and 66. As shown in FIG. 3, the faces 64 and 66 of any two axially adjacent pads 62 are arranged in direct contacting relation relative to each other. Each pad 62 furthermore defines a generally centralized bore 68 which opens at opposed ends to the surfaces 64 and 66. Preferably, the elastomeric pads 62 are configured such that their radial expansion, resulting from compressive loads being placed on surfaces 64, 66, is limited whereby preventing each pad 62 from squeezing outwardly as to significantly damage or have the operating performance of each pad 64 significantly affected.

The pads 62 can be formed from any of a myriad of thermoplastic materials. Preferably, each pad 62 is formed from a copolyesther polymer elastomer of the type manufactured and sold by the DuPont Company under the tradename HYTREL™or equivalent materials. The elastomer used to form each pad 62 has inherent physical properties making it unsuitable for use as a spring. Applicants' assignee has advantageously discovered it is possible to impart spring-like characteristics to such elastomeric materials. Co-assigned U.S. Pat. No. 4,198,037 to D. G. Anderson patent better describes the above noted polymer material and forming process. The applicable portions of U.S. Pat. No. 4,198,037 are incorporated herein by reference. Suffice it to say, each pad 62 is preferably formed from the above-described thermoplastic material and has a plastic strain to elastic strain ratio greater than 1.5 to 1.

Returning to FIG. 1, a relatively large rectangular opening 70 is preferably formed in wall 26 of the draft gear housing 16 between the closed end 20 and the inwardly directed step 29 on housing 16 (FIG. 3). Preferably, the opening 70 is disposed closer to the step 29 than to the closed end of the 20 of the housing 16. Opening 70 is sized such that one or more elastomeric pads 62 can be inserted through the opening 70 and into chamber 30 in a direction extending generally normal to the longitudinal axis 18 of assembly 10.

Assembly 10 furthermore includes a spring seat or follower 80 arranged within the draft gear housing 16 and operably disposed between the second spring end 63 and a lower end 44 of each friction member or shoe 42 of the clutch assembly 40. As shown in FIGS. 3 and 4, and when the spring seat 80 is operably arranged within the spring chamber 30 of the draft gear housing 16, the spring seat 80 extends generally normal or perpendicular to the longitudinal axis 18 of the draft gear 10. Notably, opening 70 in housing 16 is sized and configured to allow the spring seat 80 to be inserted therethrough and into chamber 30 in a direction extending generally normal to the longitudinal axis 18 of assembly 10.

As shown in FIG. 4, and after being inserted into housing chamber 30 and into operable combination with spring 60, a portion of spring seat 80 is disposed beneath the transitional step 29 defined by housing 16. In operation, the spring seat 80 engages with and slidably supports each friction shoe or member 42. Preferably, spring seat 80 has a generally planar spring engaging or contacting surface 82 which, when the spring seat 80 is arranged in operable relation with the draft gear assembly 10, is arranged in contiguous or contacting relation relative to the second end 63 of spring 60. Notably, housing 16 of assembly 10 and the spring seat 80 are so configured such that when the spring seat 80 engages with the transitional step 29 defined by housing 16, the spring engaging or contacting surface 82 is disposed near or above an upper marginal edge 71 defining opening 70 in the housing 16. In the embodiment illustrated in FIG. 2, the spring engaging surface 82 of the spring seat 80 has a generally rectangular marginal configuration, in plan, which proximates the inner surface configuration of chamber 30. As such, the spring seat 80 is maintained in longitudinal alignment with the longitudinal axis 18 of assembly 10 and is guided for reciprocatory movements by the interior surfaces of housing 16 in response to axial loads being placed upon assembly 10.

In the embodiment shown by way of example in FIGS. 3 and 4, and on that side opposite from surface 82, spring seat 80 has a surface 82' at least a portion of which, when the spring seat 80 is arranged in operable relation with the draft gear assembly 10 (FIG. 4), extends generally normal to the longitudinal axis 18 of assembly 10 so as to engage with the transitional step 29 defined by housing 16 and thereby limit upward movement of the spring seat 80 under the influence of spring 60 during operation of assembly 10. In the illustrated embodiment, seat 80 also includes a generally centrally disposed upstanding projection 84 which, when seat 80 is arranged in operable combination with assembly 10, at least partially extends into the friction bore 32 of draft gear housing 16 (FIG. 4). Preferably, an upper face or surface 85 of the projection 84 is generally planar and extends generally parallel to the spring engaging or contacting surface 82. In the illustrated embodiment, spring seat 80 furthermore defines a generally centralized bore 86 which opens to both surfaces 82 and 85 and is generally aligned with the longitudinal axis 18 after seat 80 is arranged in operable combination with assembly 10.

Spring seat 80 is formed from any suitable metallic material. In a preferred form, spring seat 80 is formed from an austempered ductile iron material. During the operation of the draft gear assembly 10, and besides moving vertically within the friction bore 32 of the draft gear housing 16, the friction shoes or members 42 likewise move radially inwardly and outwardly relative to the longitudinal axis 18 of the draft gear 10. Forming spring seat 80 preferably from the austempered ductile iron adds lubricity of the contacting surface engagement between the friction members or shoes 42 and the surface 82 of the spring seat 80.

Assembly 10 furthermore includes an axially elongated guide rod 90 having a longitudinal axis 92 arranged generally coaxial with the longitudinal axis 18 of draft gear assembly 10. Guide rod 90 preferably has a generally cylindrical configuration of a predetermined diameter for the majority of its length along with a first or lower end 94 and a second or upper end 96 arranged in general axial alignment relative to each other. Moreover, the guide rod 90 has a length defined between the ends 94, 96 which is preferably greater than the distance between the closed end 20 of the draft gear housing 16 and the upper surface 85 on spring seat 80. The guide rod 90 is insertable through and guided by the marginal edge of the bore 86 in the spring seat 80 and passes through the bore 68 in each spring pad 62 after the spring seat 80 and pads 62 of spring 60 are inserted into chamber 30. The guide rod 90 functions to maintain general alignment of the spring pads 62 relative to each other and relative to axis 18 thereby optimizing performance of the spring 60 during operation of draft gear assembly 12.

After being inserted through the bore 86 in the spring seat 80 and through the bore 68 in each of the spring pads 62, the guide rod 90 is releasably secured relative to axis 18 of the draft gear assembly 10 by structure, generally indicated in FIG. 3 by reference numeral 100. Structure 100 is configured to inhibit endwise displacement of the guide rod 90 during operation of the draft gear assembly 10. Besides securing or inhibiting endwise displacement of guide rod 90 during operation of the draft gear assembly 10, in a preferred embodiment, structure 100 conjointly facilitates alignment of the guide rod 90 and thereby the pads 62 of the spring 60 through which it passes relative to the longitudinal axis 18 of the draft gear assembly 10. Applicant recognizes and appreciates structure 100 can take different configurations and forms while serving to accomplish these desired ends.

Structure 100 includes interlocking instrumentalities, generally identified by numeral 102, for releasably holding the guide rod 90 in place while conjointly facilitating positioning of the guide rod 90 and thereby the pads 62 of spring 60 relative to the longitudinal axis 18 of assembly 10. In one form, illustrated by way of example in FIG. 7, the interlocking instrumentalities 102 include a latching mechanism, generally identified by numeral 104, which is selectively operable between locked and unlocked conditions in response to rotation of the guide rod 90 about axis 92. Preferably, mechanism 104 includes a keeper, generally identified by reference numeral 110, arranged in operable combination with the draft gear housing 18. and a latch, generally identified by numeral 130, provided on the elongated guide rod 90.

Figure 7:
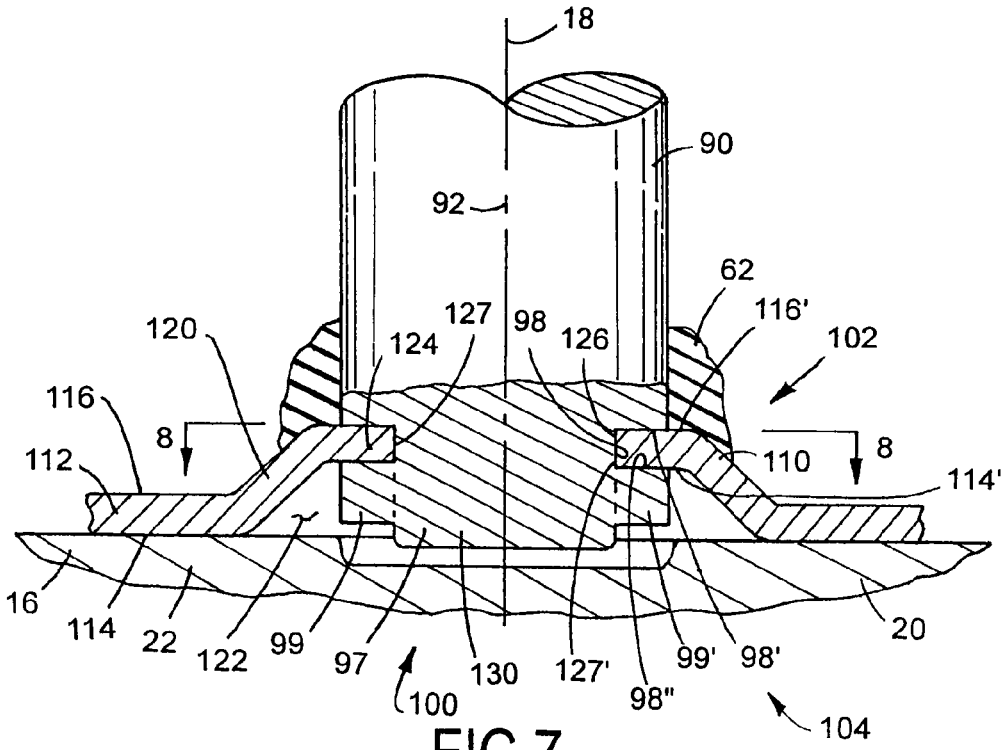
FIG. 7 is an enlarged view of the area encircled in phantom lines in FIG. 3 and showing one form of latching mechanism used in combination with this invention disclosure.

In the embodiment shown by way of example in FIG. 7, keeper 110 of mechanism 104 is provided on a metal plate 112 having generally parallel bottom and top surfaces 114 and 116, respectively, and an outer edge 118 (FIG. 3) configured to affect centering of plate 112 relative to the longitudinal axis 18 of the draft gear assembly 10. In the embodiment shown in FIG. 7, the plate 112 forming part of the latching mechanism 104 is captured between the closed end 20 of housing 16 and the elastomeric pad 62 disposed closest to the closed end 20 of housing 16.

Figure 8:
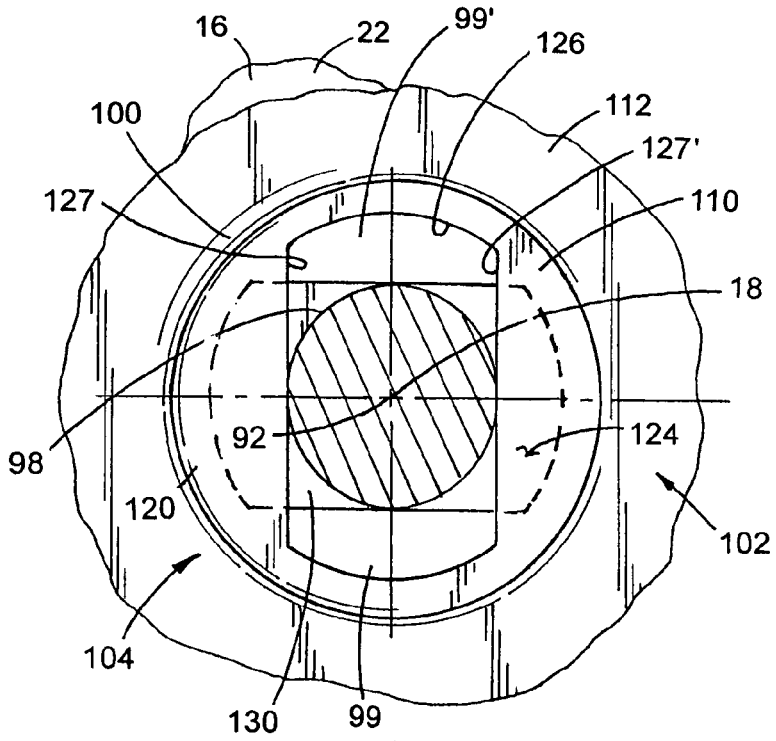
FIG. 8 is a fragmentary top plan sectional view taken along line 8-8 of FIG. 7.

As shown in FIGS. 7 and 8, plate 112 has a generally centralized boss 120 extending from the top surface 116 of plate 112 and inwardly toward the pad 62 disposed closest to the closed end 20 of housing 16 to define a void or cavity 122 between the lower surface 114' on the boss 120 and an interior surface at the closed end 20 of the housing 16. The boss 120 terminates in an inturned flange portion 124 defining an opening 126 which is generally centralized on plate 112 and opens to the void or cavity 122. The flange portion on plate 112 operably acts as the keeper 110 for latching mechanism 104. In the form shown by way of example in FIG. 8, the opening 126 defined by plate 112 has two generally parallel sides or surfaces 127 and 127' equally distanced from the longitudinal axis 18 of the draft gear assembly 10 and are separated from each other by a distance less than the predetermined diameter of the guide rod 90 (FIG. 7). In the illustrated embodiment, the marginal edge of the opening 126 defined by plate 112 is longer in a first direction than in a second direction extending generally normal to the first direction.

In this form or embodiment, the lower end 94 of the guide rod 90 is provided with the latch 130 which coacts with the keeper 110 of mechanism 104 so as to position the guide rod 90 relative to the longitudinal axis of the draft gear assembly 10 while inhibiting axial or endwise displacement of the guide rod 80 during operation of the draft gear assembly 10. In this latching mechanism embodiment, latch 130 rotates and moves with the guide rod 90.

In the form shown in FIG. 7, the lower end 94 of guide rod 90 is provided with a head portion 97 which forms part of latch 130. Head portion 97 has a cross-sectional configuration which closely resembles the marginal edge of the opening 126 defined by the boss 120 of plate 112 and includes two radial projections or lobes 99, 99', preferably formed integral with guide rod 90 and disposed in diametrically opposed relation relative to each other and to opposed sides of the longitudinal axis 92 of rod 90. After the guide rod 90 is passed through the generally centralized bore 86 in the spring seat 80 and the bore 68 in each pad 62 of spring 60 (FIG. 3), and with the guide rod 90 in a predetermined rotational position, the head portion 97 is permitted to pass through the opening 126 defined by plate 112 such that the lobes 99, 99' are rotatably accommodated within cavity 122 and beneath the lower surface 114' on the boss 120.

Between each lobe 99, 99' on the head portion 97 and the remaining length thereof, guide rod 90 is provided with a open-sided recessed channel or groove 98 having an axial width generally equal to or only slightly larger than the distance between the bottom surface 114' and a top surface 116' on the keeper 110 of mechanism 104. The groove or channel 98 provides the guide rod 90 with a pair of opposed or confronting surfaces or radial shoulders 98' and 98".

As shown in FIG. 7, when the guide rod 90 is fully inserted into operable combination with the draft gear assembly 10, and the latching mechanism 104 is in an unlocked locked condition, the projections or lobes 99,99' are disposed in generally parallel relation relative to the longer axis of the opening 126. To condition the latching mechanism 104 in a locked condition, as shown in FIG. 8, the guide rod 90 is rotated. in a first direction, about 90 degrees such that projections or lobes 99,99' are arranged in generally normal relation relative to the longer axis of the opening 126 and into the dash line position shown in FIG. 8, such that the lobes 99, 99' on guide rod 90 are disposed below and operably captured by the keeper 110. As such, the guide rod 90 is inhibited from axial displacement during operation of the assembly 10.

To allow the guide rod 90 to be removed, for whatever reason, from its operable association with housing 16, spring 60 and spring seat 80, the latching mechanism 104 is simply and readily moved to an unlocked condition. With the embodiment shown in FIGS. 7 and 8, and to accomplish conditioning the latching mechanism 104 in an unlocked condition, the guide rod 90 is simply rotated about 90 degrees, in a second direction opposed to the first direction, and about axis 92 from the locked condition or position shown in dash lines in FIG. 8, until the keeper 110 and latch 130 are no longer in operable engagement with each other whereby allowing guide rod 90 to be endwise or axially removed from effecting alignment of the pads 62 relative to the longitudinal axis 18 of assembly 10 whereby allowing the pads 62 to be removed from chamber 30 through opening 70. through the opening. In this regard, and returning to FIG. 2, wall 26' of housing 18 is preferably provided with an opening 71 disposed opposite from opening 70 to allow the pads 62 to be pushed or otherwise forcibly moved through the opening 70. More specifically, and in the above described embodiment, rotating the guide rod 90 simultaneously causes rotation of the lobes or projections 99, 99 from beneath the lower surface 114' on the keeper 110 whereby allowing the guide rod 90 to be endwise or axially removed from housing 16.

Returning to FIG. 3, the structure 100 for inhibiting endwise displacement of the guide rod 90 during operation of the draft gear assembly 10 furthermore includes an apparatus, generally identified by reference numeral 140, arranged toward the upper or second end 96 of the guide rod 90. The purpose of apparatus 140 is to inhibit inadvertent rotation of the guide rod 90 about the axis 92 thereof during operation of the draft gear assembly 10. As will be understood, by inhibiting rotation of the guide rod 90 about axis 90, the keeper 110 and latch 130 of latching mechanism 104 can be maintained in their locked condition relative to each other during operation of the draft gear assembly 10.

In the form shown by way of example in FIGS, 3 and 9, apparatus 140 includes a plate 142 disposed between face or end 85 on spring seat 80 and the friction members 42. Preferably, plate 142 is supported by the face or end 85 on the seat projection 84. In the illustrated embodiment, plate 142 is designed and configured to operably fit between but not operationally interfere with the friction members 42 and/or seat 80. Because it operably fits between the friction members 42, plate 142 is inhibited from rotating during operation of assembly 10.

Figure 9:
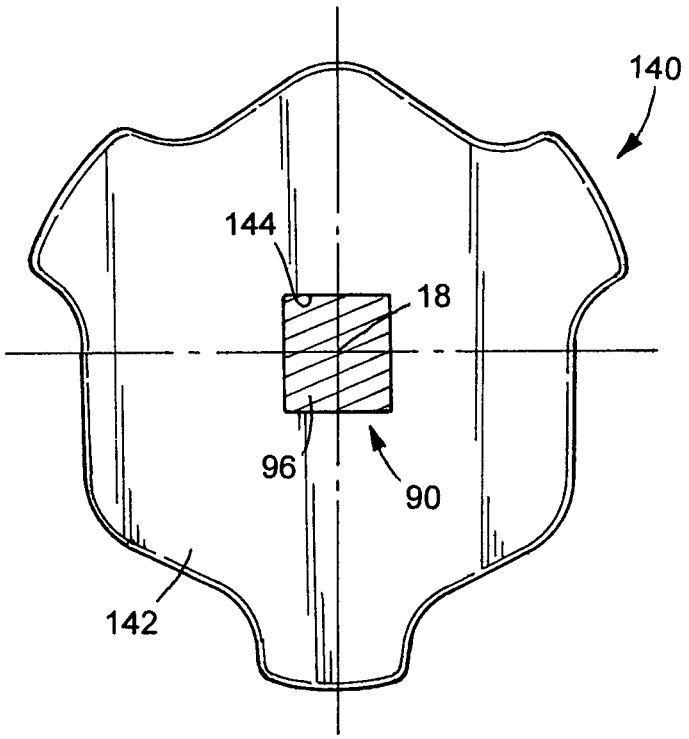
FIG. 9 is a top plan sectional view taken along lin 9-9 of FIG. 3.

As shown in FIG. 9, plate 142 defines a throughbore 144 which is arranged in axial alignment with longitudinal axis 18 of assembly 10 when plate 142 is arranged in operable combination therewith. In the embodiment shown by way of example in FIG. 9, a marginal edge 146 of the throughbore 144 defined by plate 142 has a generally square configuration. Of course, it will be appreciated, the configuration of the marginal edge 146 of bore 144 can be other than generally square, for example, it could be rectangular, triangular, oblong or any other suitable non-circular configuration without detracting or departing from the spirit and scope of this invention disclosure.

The operative length of the guide rod 90 is such that when rod 90 is arranged in a locked condition with latching mechanism 104, the upper end 96 of the rod 90 is preferably arranged in operable combination with apparatus 140. More specifically, and in that embodiment illustrated in FIG. 9, when rod 90 is arranged in a locked condition relative to latching mechanism 104, a lengthwise portion of the upper end 96 of the guide rod 90 passes endwise through and into operable combination with the bore 144 in plate 142. In this regard, at least the lengthwise portion of the guide rod upper end 96 extending from an upper terminal end of the guide rod 90 and passing endwise through plate 142 has a cross-sectional configuration generally corresponding to the marginal edge 146 of the throughbore 144 whereby inhibiting the guide rod 90 from rotating after being arranged in operable combination with plate 142. Notably, the bore 54 in wedge member 50 of the clutch assembly 40 receives and accommodates the upper end 96 of the guide rod 90 when the wedge member 50 is forcibly driven axially inward relative to the open end 20 of housing 16 during operation of the draft gear assembly 10.

Moreover, the cross-sectional configuration of at least the lengthwise portion of the guide rod upper end 96 extending from an upper terminal end of the guide rod 90 can facilitate rotation of the guide rod 90 about axis 92 through use of a suitable tool (not shown), such as a socket wrench and the like, whereby facilitating operation of the latching mechanism 104 in either a locked or unlocked condition. Alternatively, and as shown in FIGS. 3 and 4, the upper end 96 of the guide rod 90 can be configured with a suitably shaped recess such as a bore or slot 91 for releasably accommodating a tool (not shown) used to rotate guide rod 90 about axis 92 so as to facilitating operation of the latching mechanism 104 in either a locked or unlocked condition.

Figure 10:
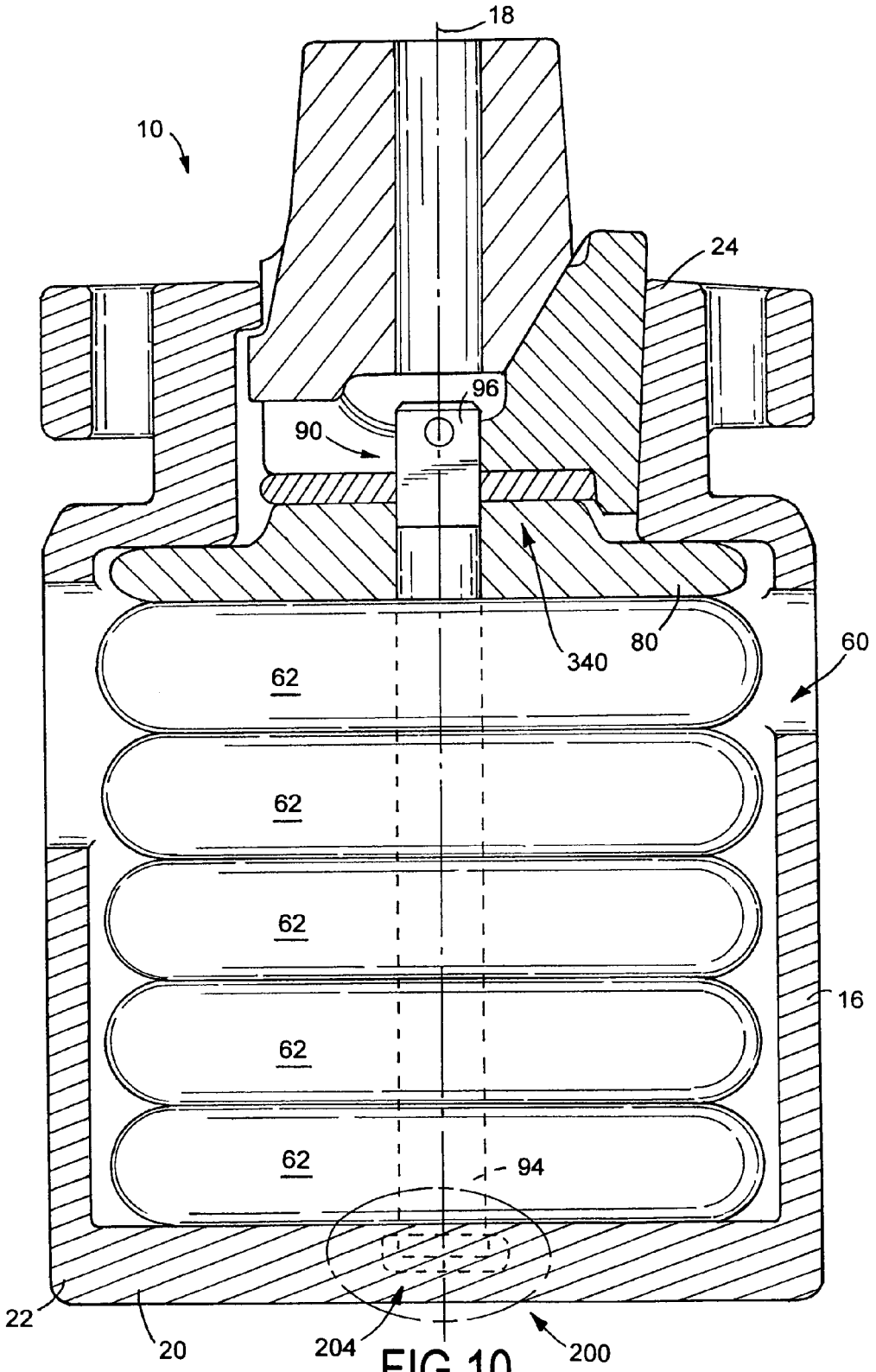
FIG. 10 is a view similar to FIG. 3 but showing a different form of latching mechanism.
Figure 11:
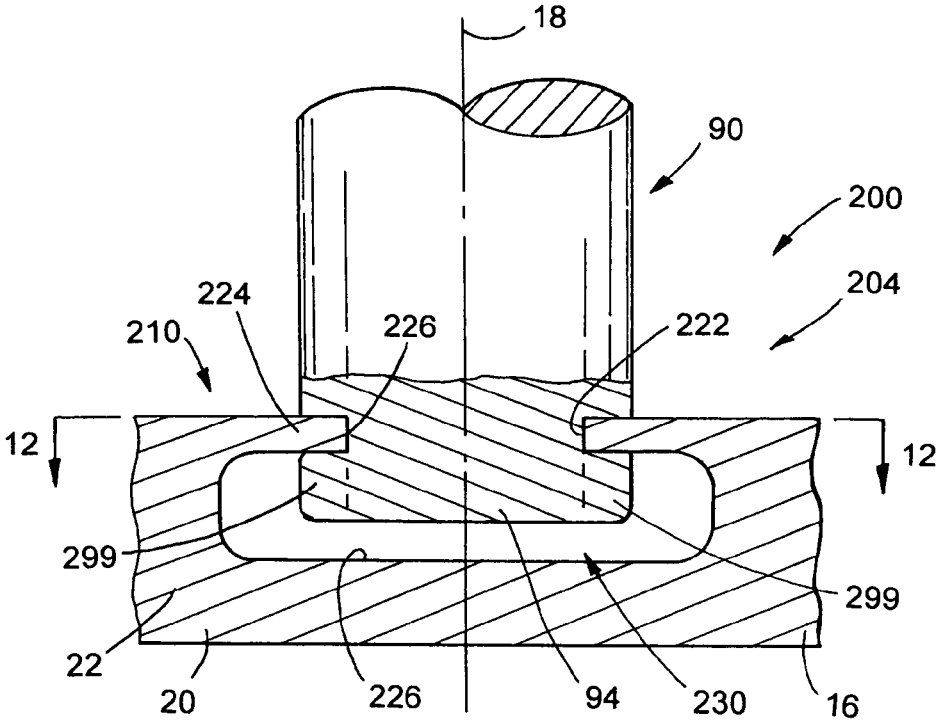
FIG. 11 is an enlarged view of the area encircled in phantom lines in FIG. 10 and showing another form of latching mechanism used in combination with this invention disclosure.
Figure 12:
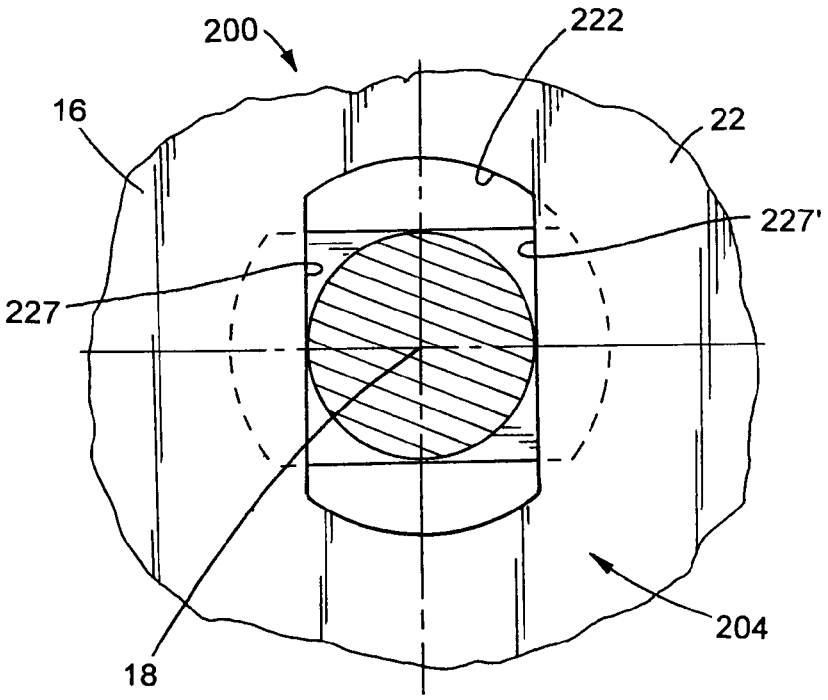
FIG. 12 is a sectional view taken along line 12-12 of FIG. 11.

As mentioned, the interlocking instrumentalities for releasably holding the guide rod 90 in place while conjointly facilitating positioning of the guide rod 90 and thereby the pads 62 of spring 60 relative to the longitudinal axis 18 of assembly 10 can take various forms without detracting or departing from the spirt and scope of this invention disclosure. FIGS. 10 through 12 illustrate another form for the interlocking instrumentalities and which includes a modified form of latching mechanism. The elements of assembly 10 which are similar to those mentioned above are identified by like reference numerals. The latching mechanism shown in FIGS. 10 through 12 is designated generally by numeral 204 and the components or elements of latching mechanism 204 which are functionally analogous to those components or elements discussed above regarding latching mechanism 104 are identified by reference numerals similar to those mentioned above with the exception this embodiment uses reference numerals in the 200 series.

As with mechanism 104, the mechanism 204 shown in FIGS. 11 and 12 includes a keeper, generally identified by numeral 210. and a latch, generally identified by numeral 230, provided on the elongated guide rod 90. In the embodiment shown by way of example in FIGS. 11 and 12, keeper 210 of mechanism 204 is configured integral with housing 16. As shown in FIG. 11, the interior surface of the end wall 22 of housing 16 has a generally centralized recess 222 therein. The recess 222 in the housing end wall 20 defines an inturned flange portion 224 and opens to a larger void or recess 222. The flange portion 224 on housing 18 operably acts as the keeper 210 for the latching mechanism 204. As with opening 126 defined by plate 112 discussed above, the opening 226 has two generally parallel sides 227 and 227' equally distanced from the longitudinal axis 18 of the draft gear assembly 10 and are separated from each other by a distance less than the predetermined diameter of the guide rod 90. In the illustrated embodiment, the marginal edge of the opening 226 defined by the flange portion 224 on housing end wall 22 is longer in a first direction than in a second direction extending generally normal to the first direction.

In the form shown in FIG. 11, the lower end 94 of the guide rod 90 is provided with a latch 230 which coacts with the keeper 210 of mechanism 204 so as to position the guide rod 90 relative to the longitudinal axis 18 of the draft gear assembly 10 while inhibiting axial or endwise displacement of the guide rod 90 during operation of the draft gear assembly 10. In this latching mechanism embodiment, latch 230 is substantially identical to latch 130 discussed above. Suffice it to say, the recess 222 defined by the end wall 22 of housing 16 is sized and configured to endwise accommodate and allow the projections or lobes 299, 299' on the head portion 297 of the guide rod 90 to pass therethrough.

As shown in FIG. 11, when guide rod 90 is fully inserted into operable combination with the draft gear assembly 10, and the latching mechanism 204 is in a locked condition, the projections or lobes 299, 299' on the head portion 297 of guide rod 90 are arranged in generally normal relation relative to the longer axis of the opening 226 and are disposed in the dash line position shown in FIG. 12. When the latching mechanism 204 is in a locked condition, as shown in FIG. 12, the keeper 210 projects into the channel or groove 298 on guide rod 90 such that the lobes 299, 299' are disposed below an operably captured by the keeper 210. As such, the guide rod 90 is inhibited from axial displacement during operation of the draft gear assembly 10.

To allow guide rod 90 to be removed, for whatever reason, from its operable association with housing 16, spring 60 and spring seat 80, the latching mechanism 204 is simply and readily moved to an unlocked condition in the same manner as discussed regarding latching mechanism 104. That is, and to condition mechanism 204 in an unlocked condition, the guide rod 90 is simply rotated about 90 degrees about axis 92 from the locked condition or position shown in dash lines in FIG. 11, until the keeper 210 and latch 230 are no longer in operable engagement with each other whereby allowing guide rod 90 to be endwise or axially removed from effecting alignment of the pads 82 relative to the longitudinal axis 18 of assembly 10 whereby allowing the pads 62 to be removed from chamber 30 through opening 70. through the opening.

Like structure 100 discussed above, the structure 200 for inhibiting endwise displacement of the guide rod 90 during operation of the draft gear assembly 10 can furthermore include an apparatus, generally identified by numeral 340 in FIG. 10, arranged toward the upper or second end 96 of the guide rod 90. The purpose of apparatus 340 is to inhibit inadvertent rotation of the guide rod 90 about its axis 92 during operation of the draft gear assembly 10. Preferably, apparatus 340 is functionally analogous to apparatus 140 discussed above and inhibits inadvertent rotation of the guide rod 90 about axis 92. As will be understood, by inhibiting rotation of the guide rod 90 about axis 92, the keeper 210 and latch 230 of latching mechanism 204 are maintained in their the locked condition relative to each other.

Figure 13:
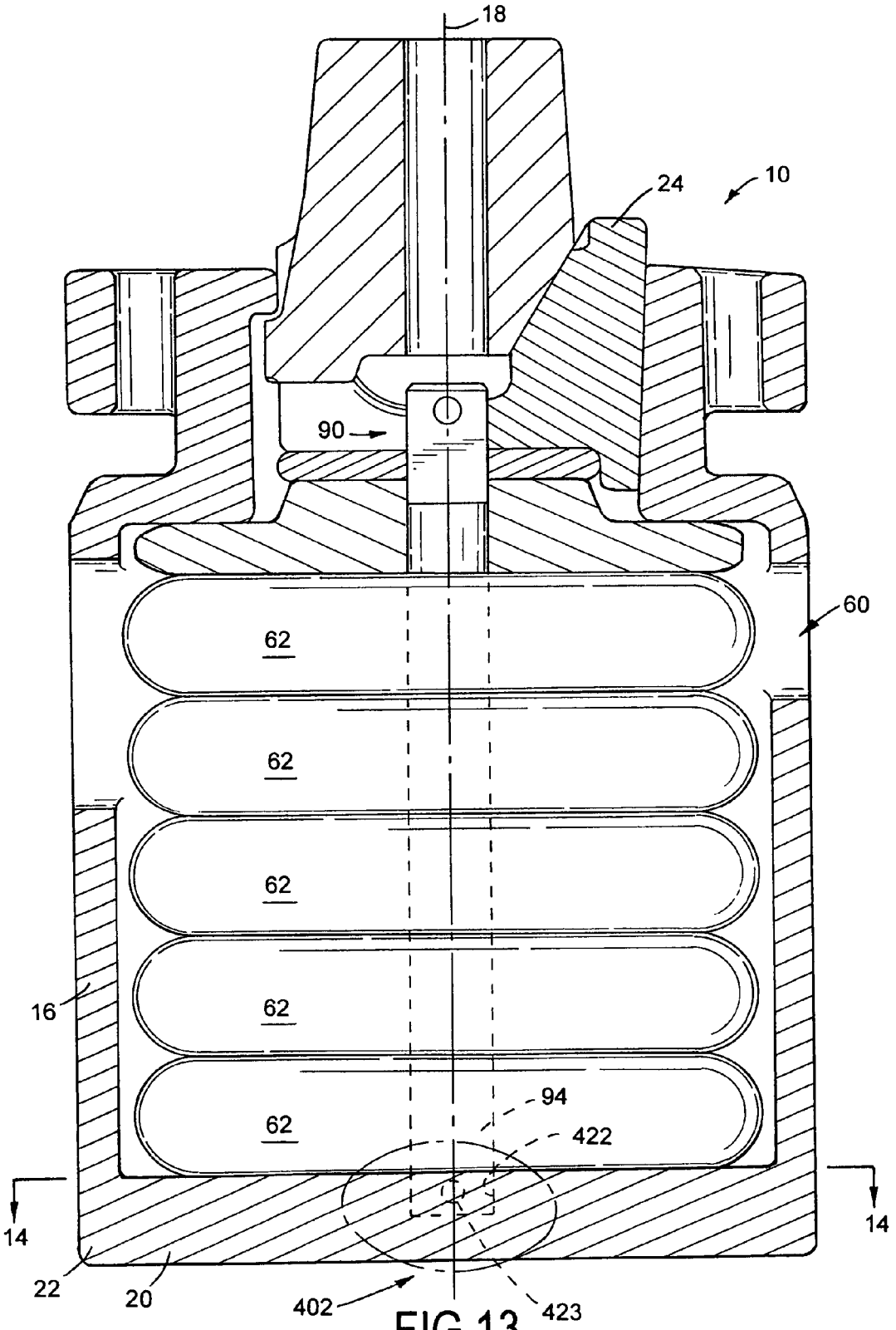
FIG. 13 is a view similar to FIG. 3 but showing a different form of latching mechanism.
Figure 14:
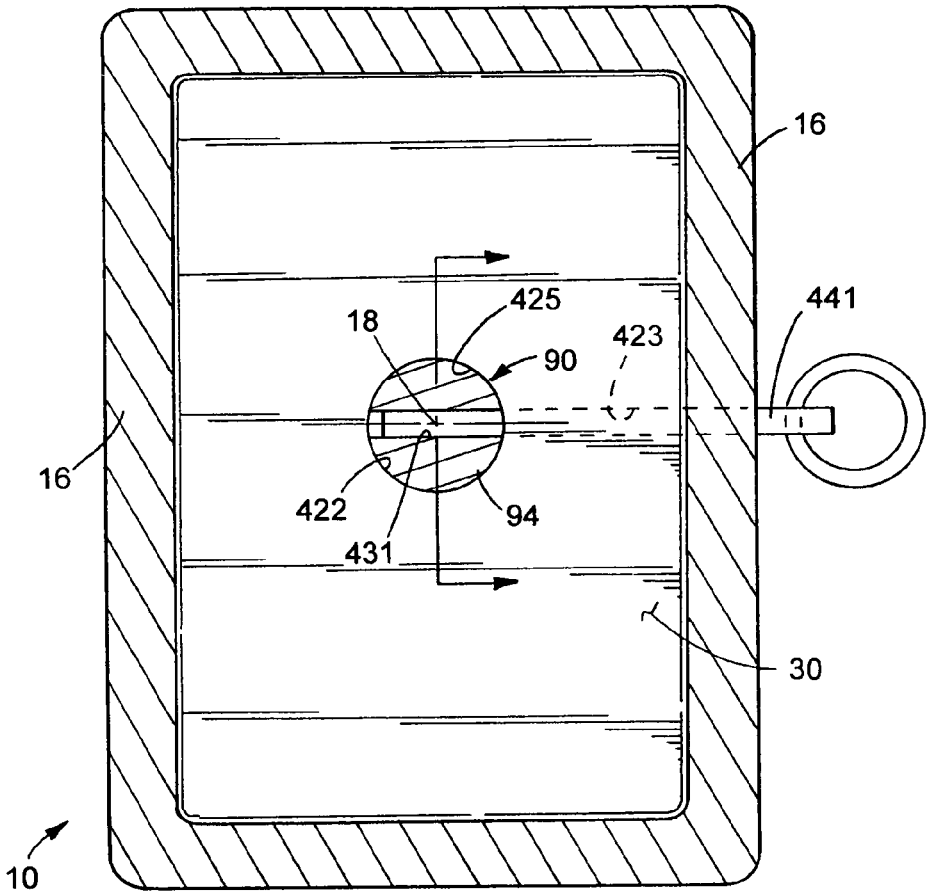
FIG. 14 is a sectional view taken along line 14-14 of FIG. 13.
Figure 15:
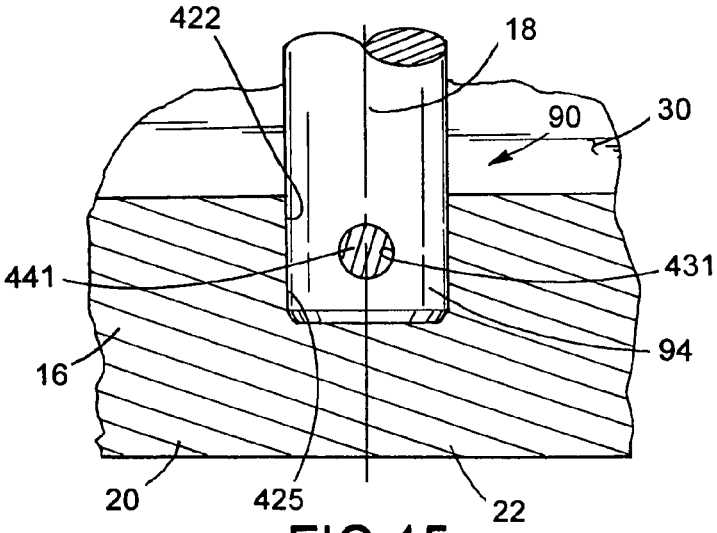
FIG. 15 is an enlarged view of the area encircled in phantom lines in FIG. 13 and showing still another form of latching mechanism used in combination with this invention disclosure.

As mentioned, the interlocking instrumentalities for releasably holding the guide rod 90 in place while conjointly facilitating positioning of the guide rod 90 and thereby the pads 62 of spring 60 relative to the longitudinal axis 18 of assembly 10 can take various forms without detracting or departing from the spirt and scope of this invention disclosure. FIGS. 13 through 15 illustrate yet another form for the interlocking instrumentalities. The elements of assembly 10 which are similar to or the functional equivalent those mentioned above are identified by like reference numerals. Numeral 402 generally designates the interlocking instrumentalities in this embodiment of the invention disclosure.

In the embodiment shown by way of example in FIGS. 13, 14 and 15, the end wall 22 of housing 18 defines a generally centralized recess 422. The recess 422 opens only to chamber 30 defined by the draft gear housing 16. Preferably, recess 422 has a closed marginal edge 425 defining a diameter for the recess 422 which is equal to or slightly larger than the predetermined diameter of the lower terminal end 94 of guide rod 90. The lower wall 22 of the draft gear housing 16 furthermore defines a bore 423 having a closed marginal edge along the length thereof and which, in a preferred form, extends generally normal to the longitudinal axis 18 of the draft gear assembly 10. At one end, bore 423 opens to the blind recess 422 of the draft gear housing 16. At an opposed end, bore 423 opens to an exterior of the draft gear housing 16.

Suffice it to say, and as shown in FIG. 15, when the guide rod 90 fully inserted into operable combination with the draft gear assembly 10, the lower end 94 of the guide rod 90 is received, accommodated and inhibited from radial shifting movements by the margin defined by the generally centralized recess 422 in the end wall 22 of the draft gear housing 16. As such, the lower end of the guide rod 90 and the pads 62 of the spring 60 arranged thereabout are generally aligned relative to the longitudinal axis 18 of the draft gear assembly 10.

Moreover, in this embodiment of the invention disclosure, the guide rod 90 is inhibited from axial shifting movements during operation of the draft gear assembly 10. To accomplish these desirable ends, and in this form or embodiment, the lower end 94 of the guide rod 90 is provided with a bore 431 which, preferably, passes through the guide rod 90 and opens at opposed ends to a periphery of the guide rod 90. Bore 431 has a diameter equal to or slightly larger than a bore 423 in the draft gear housing 16 extending generally normal to the longitudinal axis 18 o assembly 10. Moreover, and when the guide rod 90 is fully inserted into operable combination with assembly 10, the bore 431 defined at the lower end 94 of the guide rod 90 aligns with the bore 423 in the draft gear housing 16.

In this embodiment, the interlocking instrumentalities 402 further includes a locking pin or rod 441 which is selectively insertable through, removable from, and guided by the bore 423 in the draft gear housing 16. When the guide rod 90 is fully inserted into operable combination with assembly 10, the pin or rod 441 can be inserted endwise through the bore 423 in the draft gear housing and into the bore 431 on the guide rod 90 whereby inhibiting the guide rod 90 against endwise or axial movement during operation of the draft gear assembly. 10.

To allow guide rod 90 to be removed, for whatever reason, from its operable association with housing 16, spring 60 and spring seat 80, the locking pin 441 is simply and readily removed from its operable association with the guide rod 90 by removing the pin 441 from the bore 431 in the guide rod whereby allowing guide rod 90 to be endwise or axially removed from effecting alignment of the pads 82 relative to the longitudinal axis 18 of assembly 10 and thus allowing the pads 62 to be removed from chamber 30 through opening 70.

According to another aspect of this invention disclosure, there is provided a method of assembling a railcar draft gear assembly 10 having a longitudinal axis 18 and including a housing 16 with a closed end 20, an open end 24, and wall structure 25 extending between the closed and open ends 20 and 24, respectively, so as to define a chamber 30, with the wall structure defining an opening 70 having a closed margin. The method of assembling a railcar draft gear assembly 10 includes the steps of: inserting a spring seat 80 into the housing chamber 30 in a direction extending generally normal to the longitudinal axis 18 of the draft gear assembly, with the spring seat 80 defining a generally centralized bore 86 opening to opposed surfaces 82 and 85 thereof. Another step in the method involves holding the spring contacting surface 82 on the spring seat 80 in a raised position relative to the opening 70 defined by the housing 16 such that a series of elastomeric pads 62 can be inserted into the housing chamber 30 in a direction extending generally normal to the longitudinal axis 18 of the draft gear assembly and such that the pads 62 inserted into the housing chamber 30 are generally axially aligned and stacked one upon the other to define an axially elongated spring 60 extending between the closed end 20 of the housing and the spring seat 80, with each pad 62 having a generally centralized bore 68 opening to opposed surfaces 64, 66 of the pad 62. Another step involves: releasing the spring seat 80 from being held in a raised position relative to the opening 70 defined by the housing 16. Still another step in the method involves: compressing the spring lengthwise. Yet another step in the method involves: installing an elongated guide rod 90 through the centralized bore 86 in the spring seat and though the generally centralized bore 68 in each of pad 62 comprising spring 60 so as to maintain general alignment of the pads 62 relative to each other and relative to the longitudinal axis 18 of the draft gear assembly 10. The elongated guide rod 90 has an elongated axis 92. Yet another step in the process involves decompressing the spring whereby allowing the spring seat 90 to be positioned and held by the housing under the influence of the decompressed spring 60. The method also involves the step of securing the guide rod 90 within the housing 16 and in general alignment with the longitudinal axis 18 of the draft gear assembly so as to inhibit endwise displacement of the guide rod 90 relative to the housing 16 during operation of the draft gear assembly 10. Another step in the method involves: pressing a friction clutch assembly 40 into operable combination with the open end 24 of the housing 16 until an actuator 50 of the friction clutch assembly 40 is captured by the housing 16

In a preferred form, the method of assembling a railcar draft gear assembly further involves the step of: aligning the pads 62 inserted into the housing chamber 30 relative to each other before compressing the spring 60. Preferably, the step of compressing the spring 60 involves the furthers step of: a) releasing the spring seat from its raised position relative to the opening 70 in the housing 16; b) initially and axially compressing a first set of elastomeric pads 62 axially within the housing 16; c) holding the first set of elastomeric pads in an axially compressed state within the housing 16 to allow at least one additional elastomeric pad 62 to be stacked upon the first set of elastomeric pads 62; d) again raising and releasably holding the spring seat 90 relative to the opening 70 defined by the housing 70 so as to allow at least one additional elastomeric pad 62 to be inserted into the housing chamber 30 in a direction extending generally normal to the longitudinal axis 18 of said draft gear assembly 10 and in generally axially aligned and stacked relationship with the first set of pads 62, with the at least the one additional elastomeric pad 62 having a generally centralized bore 68 opening to opposed surfaces 64, 66 of the at least one additional elastomeric pad 62; e) releasing the spring seat from its raised position relative to the opening 70 defined by the housing 16; and then, f) compressing all the pads in the housing chamber 30.

Figure 16:
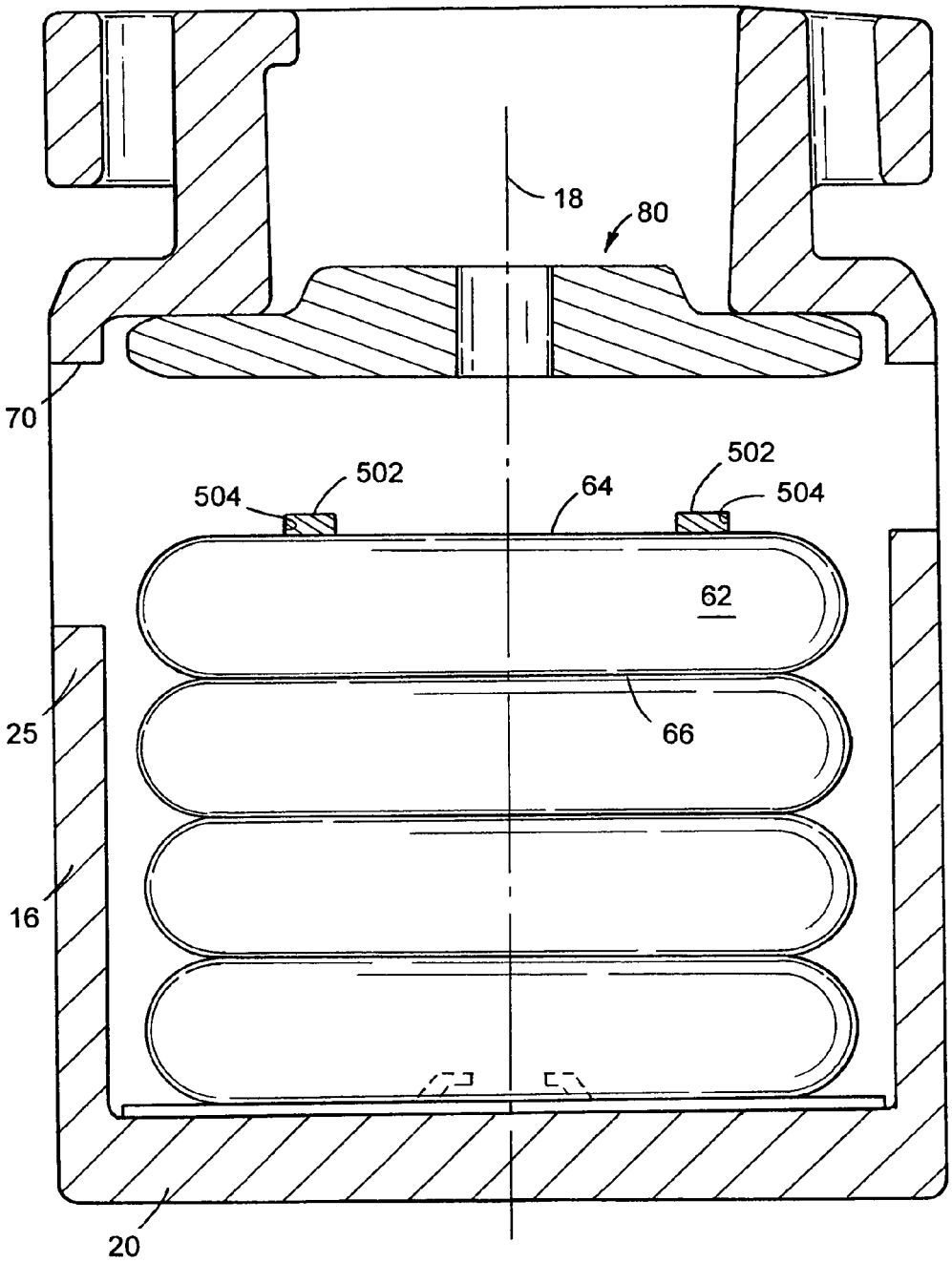
FIG. 16 is a view depicting a step in the process of assembling a draft gear assembly according to this invention disclosure.

Preferably, and as shown in FIG. 16, the step of: holding the first set of elastomeric pads in an axially compressed state within the housing involves using a plurality of bars 502 extending in sufficient engagement with an upper surface 64 of the uppermost elastomeric pad 62 in the set of pads and which are insertable through openings 504 in the wall structure 25 of housing 16 whereby maintaining the first set of elastomeric pads 62 in a compressed state within chamber 30 of housing 16. In one form, and after compressing all the pads 62 in the housing chamber 30, the plurality of bars 502 extending in sufficient engagement an upper surface 64 of the uppermost elastomeric pad 62 in the set of pads are removed so as to allow the spring 60 to assume its operational height within chamber 30 of housing 16.

In one embodiment of this invention disclosure the step of: securing an end of the guide rod 90 within the housing and in general alignment with the longitudinal axis 18 of the draft gear assembly 10 so as to inhibit endwise displacement of the guide rod 90 relative to the housing 30 during operation of the draft gear assembly 10 involves rotating the guide rod 92 about its axis 92 to interengage interlocking instrumentalities 102 on a latching mechanism 104 arranged within the housing 30. Preferably, the method of assembling a railcar draft gear assembly further involving the step of: inhibiting rotation of the guide rod 90 during operation of the draft gear assembly 10. In one embodiment, the method of assembling a railcar draft gear assembly 10 further involves the step of: configuring an end section 96 of the guide rod 90 to facilitate rotation of said guide rod 90 about the axis 92 thereof.

From the foregoing, it will be observed that numerous modifications and variations can be made and effected without departing or detracting from the true spirit and novel concept of this invention disclosure. Moreover, it will be appreciated, the present disclosure is intended to set forth an exemplification which is not intended to limit the disclosure to the specific embodiment illustrated. Rather, this disclosure is intended to cover by the appended claims all such modifications and variations as fall within the spirit and scope of the claims.

What is claimed is:

1. A railcar draft gear assembly having a longitudinal axis, comprising:

a housing having a closed end, an open end; and wall structure extending between said ends, with said wall structure defining a spring chamber and an opening in a side thereof:

a friction clutch assembly arranged in operable combination with the open end of said housing, with said friction clutch assembly including a wedge member;

a spring seat having an outer marginal edge proximating an inner marginal edge of said spring chamber such that said spring seat is guided for reciprocal movements within said spring chamber in response to forces being exerted upon said draft gear assembly, and with said spring seat having a generally centralized bore which opens to opposed surfaces of said spring seat;

an elongated spring operably disposed within and between the closed end of said housing and said clutch assembly for absorbing, dissipating and returning energy imparted to said draft gear assembly, with said spring including a series of axially stacked elastomeric pads which are inserted into said spring chamber through the opening in the side of the housing in a direction generally normal to the longitudinal axis of the draft gear assembly, with each elastomeric pad having a generally centralized bore opening to opposed surfaces of said pad;

an elongated guide rod having an axis arranged generally coaxial with the longitudinal axis of said draft gear and which is insertable endwise through said spring seat and said pads after said spring seat and pads are inserted into spring chamber for maintaining general alignment of said pads relative to each other and relative to the longitudinal axis of said draft gear assembly; and structure arranged within said housing for inhibiting endwise displacement of said guide rod during operation of said draft gear assembly, with said structure including a mechanism responsive to rotation of said guide rod in a first direction for releasably securing said guide rod to said housing in generally aligned relation relative to said longitudinal axis and to inhibit endwise displacement of said guide rod relative to said housing and with said mechanism being responsive to rotation of said guide rod in a second direction to release said guide rod from said housing, with said second direction of rotation being opposed to said first direction of rotation, and with said structure further including an apparatus for preventing inadvertent rotation of said guide rod in said second direction after said guide rod has been releasably secured to said housing.

2. The railcar draft gear assembly according to claim 1, wherein said friction clutch assembly further includes a series of friction members arranged in equally spaced relation relative to each other and in operable combination with said wedge member, and wherein the open end of said housing defines a series of inner angled longitudinally disposed surfaces extending from the open end of said housing, with each inner angled surface on said housing combining with an outer angled surface on each friction member to define an angled surface therebetween.

3. The railcar draft gear assembly according to claim 1, wherein said structure for inhibiting endwise displacement of said guide rod during operation of said draft gear assembly includes interlocking instrumentalities provided on said elongated guide rod and said housing.

4. A railcar draft gear assembly having a longitudinal axis, comprising:

a housing having a closed end, an open end; and wall structure extending between said ends, with said wall structure defining a spring chamber and an opening in a side thereof:

a friction clutch assembly arranged in operable combination with the open end of said housing, with said friction clutch assembly including a wedge member;

a spring seat having an outer marginal edge proximating an inner marginal edge of said spring chamber such that said spring seat is guided for reciprocal movements within said spring chamber in response to forces being exerted upon said draft gear assembly, and with said spring seat having a generally centralized bore which opens to opposed surfaces of said spring seat, an elongated spring operably disposed within and between the closed end of said housing and said clutch assembly for absorbing, dissipating and returning energy imparted to said draft gear assembly, with said spring including a series of axially stacked elastomeric pads which are inserted into said spring chamber through the opening in the side of the housing in a direction generally normal to the longitudinal axis of the draft gear assembly, with each elastomeric pad having a generally centralized bore opening to opposed surfaces of said pad;

an elongated guide rod having an axis arranged generally coaxial with the longitudinal axis of said draft gear and which is insertable endwise through said spring seat and said pads after said spring seat and pads are inserted into spring chamber for maintaining general alignment of said pads relative to each other and relative to the longitudinal axis of said draft gear assembly; and structure arranged within said housing for inhibiting endwise displacement of said guide rod during operation of said draft gear assembly, and wherein said structure for inhibiting endwise displacement of said guide rod during operation of said draft gear assembly includes a latching mechanism selectively operable between locked and unlocked conditions in response to rotation of said elongated guide rod about the axis thereof.

5. The railcar draft gear assembly according to claim 4, wherein said latching mechanism includes a latch secured toward a first end of and rotatable with said elongated guide rod, and a keeper carried by said housing and selectively arranged in operable combination with said latch.

6. The railcar draft gear assembly according to claim 5, wherein said guide rod is configured toward a second end to facilitate rotation of guide rod about the axis thereof.

7. The railcar draft gear assembly according to claim 5, wherein said structure for inhibiting endwise displacement of said guide rod during operation of said draft gear assembly further includes an apparatus arranged toward the second end of said elongated guide rod for inhibiting inadvertent rotation of said guide rod about the axis thereof whereby maintaining said latch and keeper in position relative to each other to inhibit endwise displacement of said guide rod after said guide rod is inserted through said pads.

8. The railcar draft gear assembly according to claim 4, wherein said latching mechanism includes a latch secured toward a first end of and rotatable with said elongated guide rod, and a keeper provided on a plate disposed between the closed end of said housing and the elastomeric pad of said spring disposed closest to the closed end of said housing, with said keeper being selectively arranged in operable combination with said latch.

9. The railcar draft gear assembly according to claim 8, wherein said guide rod is configured toward a second end to facilitate rotation of guide rod about the axis thereof.

10. The railcar draft gear assembly according to claim 8, wherein said structure for inhibiting endwise displacement of said guide rod during operation of said draft gear assembly further includes an apparatus arranged toward a second end of said elongated guide rod for inhibiting inadvertent rotation of said guide rod about the axis thereof whereby maintaining said latch and keeper in position relative to each other to inhibit endwise displacement of said guide rod after said guide rod is inserted through said pads.

11. A railcar draft gear assembly having a longitudinal axis, comprising:

an axially elongated metal housing having a closed end, an open end; and wall structure extending between said ends, with said wall structure defining a spring chamber and an opening in a side thereof:

a friction clutch assembly including an actuator extending at least partially beyond the open end of said housing and a series of equi-distantly spaced friction members arranged in operable combination with and between said actuator and the open end of said housing;

a spring seat disposed in said housing for guided reciprocatory movements and extending generally normal to the longitudinal axis of said draft gear assembly, said spring seat having a generally centralized bore opening to opposed surfaces thereof;

an elongated spring operably disposed within and between the closed end of said housing and said spring seat for absorbing, dissipating and returning energy imparted to said draft gear assembly, with said spring including a series of axially stacked elastomeric pads which are inserted into said spring chamber through the opening in the side of the housing in a direction generally normal to the longitudinal axis of the draft gear assembly, with each elastomeric pad having a generally centralized bore opening to opposed surfaces of said pad;

an elongated guide rod insertable endwise through said spring seat and said pads after said spring seat and said pads are inserted into and arranged in stacked relationship in said spring chamber; and structure arranged within said housing for inhibiting endwise displacement of said guide rod during operation of said draft gear assembly, with said structure including a mechanism responsive to rotation of said guide rod in a first direction for releasably securing said guide rod to said housing in generally aligned relation relative to said longitudinal axis and to inhibit endwise displacement of said guide rod relative to said housing, and with said mechanism being responsive to rotation of said guide rod in a second direction to release said guide rod from said housing, with said second direction of rotation being opposed to said first direction of rotation, and with said structure further including an apparatus for preventing inadvertent rotation of said guide rod in said second direction after said guide rod has been releasably secured to said housing.

12. The railcar draft gear assembly according to claim 11, wherein the friction members of said friction clutch assembly are arranged in equally spaced relation relative to each other, and wherein the open end of said housing defines a series of inner angled longitudinally extended surfaces extending from the open end of said housing, with each inner angled surface on said housing combining with an outer angled surface on each friction member to define an angled surface therebetween.

13. The railcar draft gear assembly according to claim 11, wherein said structure for inhibiting endwise displacement of said guide rod during operation of said draft gear assembly includes interlocking instrumentalities provided on said elongated guide rod and said housing.

14. A railcar draft gear assembly having a longitudinal axis, comprising:

a housing having a closed end, an open end; and wall structure extending between said ends, with said wall structure defining a spring chamber and an opening in a side thereof:

a friction clutch assembly arranged in operable combination with the open end of said housing, with said friction clutch assembly including a wedge member;

a spring seat having an outer marginal edge proximating an inner marginal edge of said spring chamber such that said spring seat is guided for reciprocal movements within said spring chamber in response to forces being exerted upon said draft gear assembly, and with said spring seat having a generally centralized bore which opens to opposed surfaces of said spring seat, an elongated spring operably disposed within and between the closed end of said housing and said clutch assembly for absorbing, dissipating and returning energy imparted to said draft gear assembly, with said spring including a series of axially stacked elastomeric pads which are inserted into said spring chamber through the opening in the side of the housing in a direction generally normal to the longitudinal axis of the draft gear assembly, with each elastomeric pad having a generally centralized bore opening to opposed surfaces of said pad;

an elongated guide rod having an axis arranged generally coaxial with the longitudinal axis of said draft gear and which is insertable endwise through said spring seat and said pads after said spring seat and pads are inserted into spring chamber for maintaining general alignment of said pads relative to each other and relative to the longitudinal axis of said draft gear assembly; and structure arranged within said housing for inhibiting endwise displacement of said guide rod during operation of said draft gear assembly, and wherein said structure for inhibiting endwise displacement of said guide rod during operation of said draft gear assembly includes a latching mechanism selectively operable between locked and unlocked conditions in response to rotation of said elongated guide rod about the axis thereof.

15. The railcar draft gear assembly according to claim 14, wherein said latching mechanism includes a latch secured toward a first end of and rotatable with said elongated guide rod, and a keeper carried by said housing and selectively arranged in operable combination with said latch.

16. The railcar draft gear assembly according to claim 14, wherein said guide rod is configured toward a second end to facilitate rotation of guide rod about the axis thereof.

17. The railcar draft gear assembly according to claim 14, wherein said structure for inhibiting endwise displacement of said guide rod during operation of said draft gear assembly further includes an apparatus arranged toward the second end of said elongated guide rod for inhibiting inadvertent rotation of said guide rod about the axis thereof whereby maintaining said latch and keeper in position relative to each other to inhibit endwise displacement of said guide rod after said guide rod is inserted through said pads.

18. The railcar draft gear assembly according to claim 17, wherein said latching mechanism includes a latch secured toward a first end of and rotatable with said elongated guide rod, and a keeper provided on a plate disposed between the closed end of said housing and the elastomeric pad of said spring disposed closest to the closed end of said housing.

19. The railcar draft gear assembly according to claim 18, wherein said guide rod is configured toward a second end to facilitate rotation of guide rod about the axis thereof.

20. The railcar draft gear assembly according to claim 19, wherein said structure for inhibiting endwise displacement of said guide rod during operation of said draft gear assembly further includes an apparatus arranged toward the second end of said elongated guide rod for inhibiting inadvertent rotation of said guide rod about the axis thereof whereby maintaining said latch and keeper in position relative to each other to inhibit endwise displacement of said guide rod after said guide rod is inserted through said pads.

21. A method of assembling a railcar draft gear assembly having a longitudinal axis and including a housing with a closed end, an open end, and wall structure extending between said closed end and said open end so as to define a chamber, with said wall structure defining an opening having a closed margin, said method of assembling a railcar draft gear assembly comprising the steps of:

inserting a spring seat into the chamber defined by said housing in a direction extending generally normal to the longitudinal axis of said draft gear assembly, with said spring seat defining a generally centralized bore opening to opposed surfaces thereof;

holding said spring seat in a raised position relative to the opening defined by said housing;

inserting a series of elastomeric pads into the chamber defined by said housing in a direction extending generally normal to the longitudinal axis of said draft gear assembly such that said pads are stacked one upon the other to define an axially elongated spring extending between the closed end of said housing and said spring seat, with each pad having a generally centralized bore opening to opposed surfaces of said pad;

releasing said spring seat from being held raised relative to the opening defined by said housing;

compressing said spring;

installing an elongated guide rod through the centralized bore in the said spring seat and though the generally centralized bore in each of said pads so as to maintain general alignment of the pads relative to each other and relative to the longitudinal axis of said draft gear assembly, with said guide rod having an elongated axis;

decompressing said spring whereby allowing said spring seat to be positioned and held by said housing under the influence of the decompressed spring;

securing an opposed end of said guide rod within said housing and in general alignment with the longitudinal axis of the draft gear assembly so as to maintain general alignment of the pads relative to each other and relative to the longitudinal axis of said draft gear assembly while inhibiting endwise displacement of said guide rod relative to said housing during operation of said draft gear assembly; and pressing a friction clutch assembly into operable combination with the open end of said housing until an actuator of said friction clutch assembly is captured by said housing.

22. The method of assembling a railcar draft gear assembly according to claim 21 further involves the step of: aligning at least some of the pads in said chamber relative to each other manually before compressing the spring.

23. The method of assembling a railcar draft gear assembly according to claim 22 wherein, and after the spring seat is released, the step of compressing said spring involves the further steps of: a) initially compressing a first set of elastomeric pads axially within said housing; b) holding said first set of elastomeric pads in an axially compressed state within said housing to allow at least one additional elastomeric pad to be stacked upon said first set of elastomneric pads; c) raising said spring seat relative to the opening defined by said housing; d) inserting at least one additional elastomeric pad into the chamber defined by said housing in a direction extending generally normal to the longitudinal axis of said draft gear assembly and in generally axially aligned and stacked relationship with the first set of pads, with said at least one additional elastomeric pad having a generally centralized bore opening to opposed surfaces of said at least one additional elastomeric pad; e) releasing said spring seat from being held in a raised position relative to the upper marginal edge of the opening defined by said housing; and then, f) compressing all the pads in said chamber.

24. The method of assembling a railcar draft gear assembly according to claim 23 wherein the step of: holding said first set of elastomeric pads in an axially compressed state within said housing involves arranging a plurality of limitation bars in operable combination with an uppermost elastomeric pad in said first set of pads so as to limit axial expansion of said first set of elastomeric pads in said housing.

25. The method of assembling a railcar draft gear assembly according to claim 23 wherein after compressing all the pads in said chamber, said plurality of limitation bars arranged in operable combination with the uppermost elastomeric pad in said first set of pads are removed so as to permit axial expansion of said spring within said chamber.

26. The method of assembling a railcar draft gear assembly according to claim 21 wherein the step of: securing a first end of said guide rod within said housing and in general alignment with the longitudinal axis of the draft gear assembly thereby inhibiting endwise displacement relative to said housing during operation of said draft gear assembly involves rotating said guide rod to interengage cooperating instrumentalities on a latching mechanism arranged within said housing.

27. The method of assembling a railcar draft gear assembly according to claim 26 further involving the step of: inhibiting rotation of said guide rod during operation of said draft gear assembly.

28. The method of assembling a railcar draft gear assembly according to claim 26 further involving the step of configuring an end section of said guide rod to facilitate rotation of said guide rod about the axis thereof.

* * * * *